US009904196B1

(12) United States Patent
Yoshida et al.

(10) Patent No.: US 9,904,196 B1
(45) Date of Patent: Feb. 27, 2018

(54) WHITE TONER FOR DEVELOPING ELECTROSTATIC CHARGE IMAGE, ELECTROSTATIC CHARGE IMAGE DEVELOPER, AND TONER CARTRIDGE

(71) Applicant: FUJI XEROX CO., LTD., Tokyo (JP)

(72) Inventors: Kana Yoshida, Kanagawa (JP); Atsushi Sugawara, Kanagawa (JP); Tsuyoshi Murakami, Kanagawa (JP); Masaki Iwase, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/581,284

(22) Filed: Apr. 28, 2017

(30) Foreign Application Priority Data

Oct. 25, 2016 (JP) ..... 2016-208787

(51) Int. Cl.

| | |
|---|---|
| ***G03G 9/08*** | (2006.01) |
| ***G03G 9/09*** | (2006.01) |
| ***G03G 9/087*** | (2006.01) |
| ***G03G 15/08*** | (2006.01) |
| ***G03G 9/083*** | (2006.01) |

(52) U.S. Cl.
CPC ..... *G03G 9/0902* (2013.01); *G03G 9/0819* (2013.01); *G03G 9/0821* (2013.01); *G03G 9/0825* (2013.01); *G03G 9/0837* (2013.01); *G03G 9/08755* (2013.01); *G03G 9/0926* (2013.01); *G03G 15/0865* (2013.01)

(58) Field of Classification Search
CPC ... G03G 9/0902; G03G 9/0926; G03G 9/0837
USPC ..... 430/108.1
See application file for complete search history.

(56) References Cited

FOREIGN PATENT DOCUMENTS

JP 2006-220694 A 8/2006

*Primary Examiner* — Mark A Chapman
(74) *Attorney, Agent, or Firm* — Sughrue Mion, PLLC

(57) ABSTRACT

A white toner for developing an electrostatic charge image includes a white toner particle containing a binder resin and a white pigment particle, wherein, when a number average circle equivalent diameter of the white pigment particles, which are observed in a sectional image of the white toner particle, is taken as A, and a number average circle equivalent diameter of the white pigment particles, which are present in a surface layer portion within 35% from a surface of the white toner particle with respect to a particle diameter thereof, is taken as B, a relationship expressed by A>B is satisfied.

10 Claims, 3 Drawing Sheets

WHITE TONER FOR DEVELOPING ELECTROSTATIC CHARGE IMAGE, ELECTROSTATIC CHARGE IMAGE DEVELOPER, AND TONER CARTRIDGE

CROSS-REFERENCE TO RELATED APPLICATIONS

This application is based on and claims priority under 35 USC 119 from Japanese Patent Application No. 2016-208787 filed Oct. 25, 2016.

BACKGROUND

Technical Field

The present invention relates to a white toner for developing an electrostatic charge image, an electrostatic charge image developer, and a toner cartridge.

SUMMARY

According to an aspect of the invention, there is provided a white toner for developing an electrostatic charge image, including:

a white toner particle containing a binder resin and a white pigment particle, wherein, when a number average circle equivalent diameter of the white pigment particles, which are observed in a sectional image of the white toner particle, is taken as A, and a number average circle equivalent diameter of the white pigment particles, which are present in a surface layer portion within 35% from a surface of the white toner particle with respect to a particle diameter thereof, is taken as B, a relationship expressed by A>B is satisfied.

BRIEF DESCRIPTION OF THE DRAWINGS

Exemplary embodiments of the present invention will be described in detail based on the following figures, wherein.

DETAILED DESCRIPTION

Figure 1:
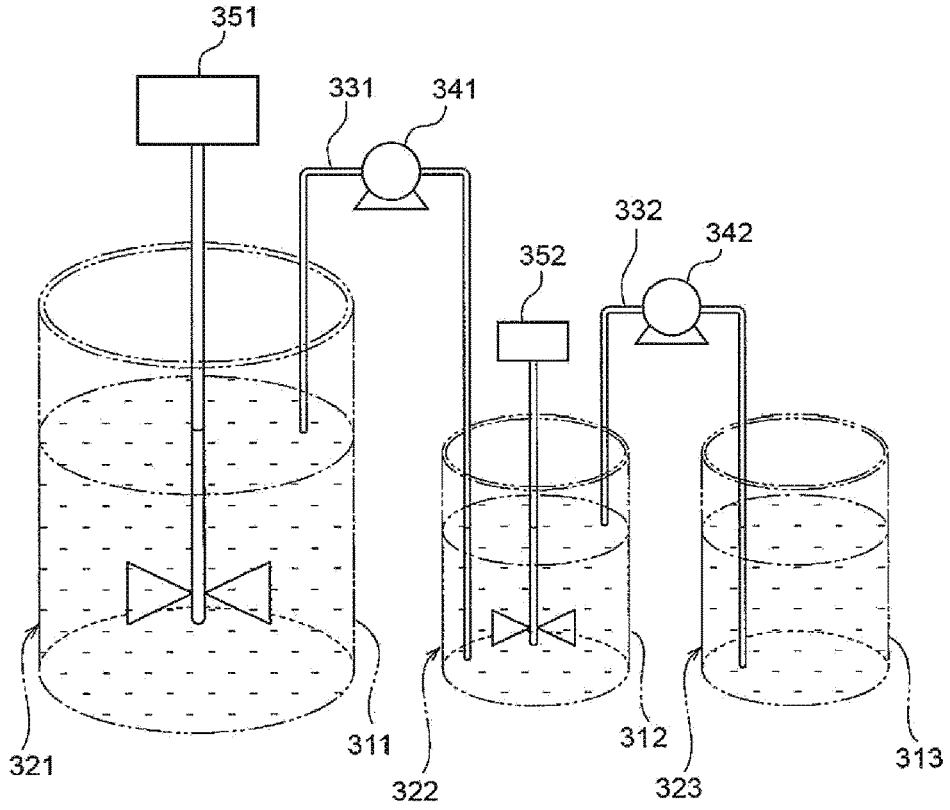
FIG. 1 is a schematic diagram illustrating a power feeding addition method.

Hereinafter, the exemplary embodiment will be described.

White Toner for Developing Electrostatic Charge Image

A white toner for developing an electrostatic charge image (hereinafter, also simply referred to as "white toner" or "toner") according to the exemplary embodiment contains a white toner particle having a binder resin and a white pigment particle.

In addition, when a number average circle equivalent diameter of the white pigment, particle which is observed in a sectional image of the white toner particle, is taken as A, and a number average circle equivalent diameter of the white pigment particles, which are present in a surface layer portion within 35% from the surface of the white toner particle with respect to a particle diameter thereof, is taken as B, a relationship expressed by A>B is satisfied.

The white toner particle contained in the white toner according to the exemplary embodiment contains a white pigment particle in a state where the relationship between the number average circle equivalent diameter A of the white pigment particles present in the entirety of the white toner particle, and the number average circle equivalent diameter B of the white pigment particles present in a surface layer portion of the white toner particle satisfies A>B.

The white toner particle is a white toner particle containing a white pigment particle in a state where the relationship expressed by A>B is satisfied. In other words, the white toner particle in the exemplary embodiment contains a white pigment particle having a relatively small diameter (hereinafter, also simply referred to as "small-diameter pigment particle"), and a white pigment particle having relatively large diameter (hereinafter, also simply referred to as "large-diameter pigment particle"), and the small-diameter pigment particles are unevenly distributed in the surface layer portion.

Here, the equivalent circle diameter means a diameter of a true circle having the same area as that of a projected image of the white pigment particle at the time of observing the cross section of the white toner particle with a microscope. A primary particle is set as the white pigment particle to be measured.

In addition, even with small amount of excessively large diameter particles and excessively small diameter particles, it causes a large influence on an average diameter (average circle equivalent diameter), and when the average diameter is calculated after the excessively large and small diameter particles are excluded, it is possible to calculate an average diameter more reflecting the overall tendency. Accordingly, in the exemplary embodiment, in order to reduce the influence of excessively small diameter white pigment particles (the primary particle) and excessively large diameter white pigment particles (the primary particle), in the particle diameter distribution of the white pigment particle based on the number, the equivalent circle diameter is limited to having a cumulative value in a range of 16% to 84% from the small diameter side, and the equivalent circle diameter having a cumulative value of 50% within the range of 16% to 84% is denoted as a number average circle equivalent diameter. Note that, a method of measuring the number average circle equivalent diameter will be described below in detail.

Here, in the related art, the white toner is frequently used for forming a white base on colored paper such as color paper and black paper, and for forming a white base on a film. In a case of such an application, the white toner requires high concealing properties. When the concealing properties are relatively deteriorated, the toner image formed on the white base is likely to be unclear. Therefore, in order to realize more excellent concealing properties, the white toner is desired to contain a large amount of the white pigment particles, and to form a white toner layer (hereinafter, also simply referred to as "toner layer") at a high pile height (high toner applied amount (TMA), for example, in a range of 12 $g/m^2$ to 15 $g/m^2$) higher than that of the colored toner. However, when the toner layer is formed with the high toner applied amount, the fixing strength is likely to be deteriorated.

In particular, from the viewpoint of energy saving, it is desired to fix the white toner on the film at a lower temperature (for example, in a range of 140° C. to 160° C.), and in this case, the fixing strength is more likely to be deteriorated, and thus cracks and peeling of the toner layer are caused.

On the other hand, in a case where the toner layer is formed with a low toner applied amount (for example, in a range of 5 g/m$^2$ to 8 g/m$^2$), when the fixing temperature becomes higher (for example, in a range of 180° C. to 200° C.), a portion of the white toner remains on the fixing member side, and a so-called hot offset phenomenon is likely to occur.

In contrast, the white toner particles in the exemplary embodiment include small-diameter pigment particles and large-diameter pigment particles. The large-diameter pigment particles greatly contribute to the concealing properties as compared with the small-diameter pigment particles. That is, in the white toner of the exemplary embodiment, the concealing properties are improved by containing the large-diameter pigment particles in the white toner particles. Then, the white toner particles in a state where the small-diameter pigment particles are unevenly distributed in the surface layer portion are employed. With this, it is possible to obtain a white toner in which the excellent fixability at a low temperature and the hot offset resistance are realized.

Although the reason is not clear, the following reasons may be presumed.

In order to realize the excellent fixability at the low temperature, it is desired to enhance the fixing strength of the fixed image by factors other than the fixing temperature. For example, in a case of using the white toner particle in which the relationship between the above-described number average circle equivalent diameters A and B is A≤B, that is, the white toner particle having a relatively large amount of large-diameter pigment particles which are present in the surface layer portion, a contact area between a recording medium and the binder resin at the time of fixing is likely to be reduced due to the influence of the large-diameter pigment particles which are present in the surface layer portion, and thus the fixing strength is hardly secured. In contrast, in the exemplary embodiment, the white toner particle in which the small-diameter pigment particles are unevenly distributed in the surface layer portion is used, and thus the above-described contact area is hardly reduced. With this, the adhesion between the recording medium and the binder resin at the time of fixing is enhanced, thereby improving the fixing strength. In addition, as the fixing strength is improved, the cracks and peeling of the toner layer are likely to be prevented.

Further, it is considered that a filler effect of the small sized particle is exhibited by unevenly distributing the small-diameter pigment particles in the surface layer portion. The above-described filler effect is exhibited from the viewpoint of improving the releasability of the white toner with respect to a fixing member at the time of fixing. With this, even at the time of fixing at a high temperature, the releasability between the white toner and the fixing member is enhanced so as to prevent the occurrence of the hot offset.

In addition, the degree of melting (for example, excessive deterioration of the viscosity) of the binder resin at the time of fixing at a high temperature is easily adjusted by the above-described filler effect. With this, it is considered that the occurrence of the hot offset is prevented.

From the above description, according to the white toner of the exemplary embodiment, it is possible to obtain the white toner in which the excellent fixability at the low temperature and the hot offset resistance are realized.

Particularly, unlike the fixing on the paper, in the fixing of the white toner on the film, it is susceptible to thermal extension and contraction of the binder resin at the time of fixing. Specifically, at the time of fixing, the white toner is heated and melted, and is cooled and solidified after contacting the recording medium, thereby being fixed on the recording medium. At this time, when a film is used as the recording medium, the binder resin hardly infiltrates into the film, and thus due to the contraction generated at the time of cooling and solidifying, the adhesion between the binder resin and the film is likely to be deteriorated. As a result, the fixing strength is more likely to be deteriorated.

In contrast, the thermal extension and the contraction hardly are less likely to occur in the white pigment particles contained in the white toner particles in the exemplary embodiment as compared with the binder resin, and particularly, in a case of using an inorganic particle (for example, titanium oxide and zinc oxide) as the white pigment particle, the thermal extension and the contraction are more reduced. In the exemplary embodiment, among the white pigment particles, the small-diameter pigment particles are unevenly distributed in the surface layer portion of the white toner particle, and thus the thermal extension and the contraction of the binder resin at the time of fixing are more reduced by the filler effect. With this, the adhesion between the binder resin and the film is likely to be secured, and as a result, even when the binder resin is fixed on the film, the deterioration of the fixing strength is prevented.

Note that, in the exemplary embodiment, a material of the small-diameter pigment particle exhibiting the filler effect is preferably the same as that of the large-diameter pigment particle contained in the white toner particle. With this, whiteness and hue at the time of forming the toner layer are hardly deteriorated.

Number Average Circle Equivalent Diameter A and Number Average Circle Equivalent Diameter B (A>B)

The toner particle contained in the toner according to the exemplary embodiment satisfies the relationship between "the number average circle equivalent diameter A of the white pigment particles present in the entirety of the white toner particle">"the number average circle equivalent diameter B of the white pigment particles present in the surface layer portion". In other words, B is less than 100% with respect to A.

Note that, regarding the relationship between A and B (the ratio of B to A), from the viewpoint of realizing the excellent fixability at the low temperature and the hot offset resistance, B is preferably equal to or less than 50% with respect to A, and B is preferably equal to or less than 25% with respect to A.

On the other hand, when B is excessively less than A, the specific surface area of the white pigment is enlarged, and thus the catalytic activity is likely to be improved particularly in the white pigment having the photocatalytic activity. As a result, a resin in the toner particle may be accelerated to be deteriorated. Therefore, as the lower limit of the relationship between A and B (the ratio of B to A), B is preferably equal to or greater than 5% and is further preferably equal to or greater than 10% with respect to A.

Surface Layer Portion of White Toner Particle

The "surface layer portion" of the white toner particle will be described. The "surface layer portion within 35% from the surface of the white toner particle with respect to the particle diameter thereof" means a region between a line which connects positions corresponding to 35% of the particle from the surfaces of both ends of the particle with respect to the length of a straight line passing through a center point (that is, the center of the equivalent circle diameter) of the white toner particle and the surface of the white toner particle.

Then, as an index of the large-diameter pigment particle and the small-diameter pigment particle, various ratios in the toner particle which contains the white pigment particle having the equivalent circle diameter in a range of 200 nm to 400 nm, and the white pigment particle having the equivalent circle diameter in a range of 10 nm to 100 nm will be described below.

Note that, in the following description, the white pigment particle having the equivalent circle diameter in a range of 200 nm to 400 nm is referred to as a "specific range large-diameter particle" and the white pigment particle having the equivalent circle diameter in a range of 10 nm to 100 nm is referred to as a "specific range small-diameter particle".

Here, the reason why the index of the large-diameter pigment particle is set such that the equivalent circle diameter is in a range of 200 nm to 400 nm is as follows.

In a case of the white pigment particle having the equivalent circle diameter of equal to or less than 400 nm, the stress generated at the time of bending the toner layer is dispersed and thus concentration of the stress is easily prevented. With this, the deterioration of the fixing strength is easily prevented, as result; the cracking and peeling of the toner layer are less likely to occur. In addition, the white pigment particle containing the equivalent circle diameter in the above-described range is effective in scattering of visible light. With this, the concealing properties of the white toner are improved. The reason for this, according to Mie scattering theory, is that the light effectively scatters when the particle diameter is about ½ of the wavelength of the light, and the large-diameter pigment particle having the equivalent circle diameter in the above-described range easily satisfies the conditions of the light scattering.

Further, the reason why the index of the small-diameter pigment particle is set such that the equivalent circle diameter is in a range of 10 nm to 100 nm is as follows.

In a case of the white pigment particle having the equivalent circle diameter in a range of 10 nm to 100 nm, the specific surface area is relatively enlarged, and thus the filler effect is likely to be exhibited. With this, even when the fixing is performed at a high temperature, the releasability between the toner layer and the fixing member is enhanced, and thus the hot offset is less likely to occur.

In the white toner particles in the exemplary embodiment, from the viewpoint of realizing the excellent fixability at the low temperature and the hot offset resistance, preferable ranges of a ratio of the area occupied (area occupancy ratio) by the specific range small-diameter particles in the surface layer portion, the number of the specific range large-diameter particles and the number of the specific range small-diameter particles which are present in the entirety of the white toner particle, the number of the specific range large-diameter particles and the number of the specific range small-diameter particles which present in the surface layer portion, the ratio (surface layer portion/inner portion) of the area occupancy ratio of the specific range small-diameter particles, and the ratio (surface layer portion/inner portion) of the area occupancy ratio of the specific range large-diameter particles are as follows.

Area Occupancy Ratio of Small-Diameter Particles in Specific Range in Surface Layer Portion In the white toner particles in the exemplary embodiment, the area occupancy ratio of the specific range small-diameter particles in the surface layer portion is preferably in a range of 5% to 50%, is further preferably in a range of 10% to 40%, and still further preferably in a range of 15% to 25%.

Here, the area occupancy ratio of the specific range small-diameter particles in the surface layer portion means the ratio of the area of the specific range small-diameter particles present in the surface layer portion with respect to the cross section of the surface layer portion.

When the area occupancy ratio of the specific range small-diameter particles in the surface layer portion is in the above-described range, the deterioration of the meltability of the binder resin at the time of fixing is likely to be prevented. With this, it is likely to obtain a target minimum film formation temperature (MFT).

Here, the white toner particles in which the area occupancy ratio of the specific range small-diameter particles in the surface layer portion is in the above-described range indicate that the specific range small-diameter particles are appropriately present in the surface layer portion.

With this, the filler effect of the specific range small sized particle is likely to be exhibited. Particularly, when the white toner is fixed on the film, the binder resin hardly infiltrates into the film; however, when the specific range small-diameter particles are unevenly distributed in the surface layer portion, the filler effect is exhibited, and thus the thermal extension and the contraction of the binder resin at the time of fixing are likely to be prevented. With this, the adhesion between the binder resin and the film is further likely to be enhanced, and as a result, the deterioration of the fixing strength is further likely to be prevented even when the fixing is performed at the low temperature.

The number of specific range large-diameter particles and the number of specific range small-diameter particles, which are present in the entirety of the white toner particle With respect to all of the white pigment particles present in the entirety of the white toner particle, the number of the specific range large-diameter particles is preferably equal to or greater than 40% by number, is further preferably equal to or greater than 50% by number, and is still further preferably equal to or greater than 60% by number. On the other hand, the upper limit thereof is preferably equal to or less than 90% by number, and is further preferably equal to or less than 85% by number.

When the number of the specific range large-diameter particles is equal to or greater than 40% by number, the concealing properties are likely to be secured. The reason for this is that the scattering effect of light based on Mie scattering theory is likely to be realized. On the other hand, when the number of the specific range large-diameter particles is equal to or less than 90% by number, it is likely to obtain the toner particles satisfying the relationship of "the number average circle equivalent diameter A of the white pigment particles present in the entirety of the white toner particle">"the number average circle equivalent diameter B of the white pigment particles present in the surface layer portion".

With respect to all of the white pigment particles present in the entirety of the white toner particle, the number of the specific range small-diameter particles is preferably in a range of 5% by number to 15% by number, is further preferably in a range of 7% by number to 13% by number, and still further preferably in a range of 8% by number to 10% by number.

When the number of the specific range small-diameter particles is equal to or greater than 5% by number, the filler effect is likely to be exhibited. With this, the releasability of the white toner and the fixing member is further likely to be enhanced even when the fixing is performed at the high temperature, and as a result, the hot offset is less likely to occur.

When the number of the specific range small-diameter particle is equal to or less than 15% by number, the content of the resin is relatively increased, and thus the meltability of the toner at the time of fixing is less likely to be deteriorated. With this, it is likely to obtain a target minimum film formation temperature (MFT).

The number of specific range large-diameter particles and the number of specific range small-diameter particles which are present in surface layer portion With respect to the all of the white pigment particles present in the surface layer portion of the white toner particle, the number of the specific range large-diameter particles is preferably equal to or less than 20% by number, is further preferably equal to or less than 18% by number, and still further preferably equal to or less than 15% by number. On the other hand, the lower limit thereof is preferably equal to or greater than 3% by number, and is further preferably equal to or greater than 5% by number.

Further, with respect to all of the white pigment particles present in the surface layer portion of the white toner particle, the number of the specific range small-diameter particle is preferably in a range of 10% by number to 50% by number, is further preferably in a range of 20% by number to 40% by number, and is still further preferably in a range of 25% by number to 35% by number.

When the number of the specific range large-diameter particles is equal to or less than 20% by number, the deterioration of the contact area between the recording medium and the binder resin at the time of fixing is likely to be prevented. With this, the fixing strength is likely to be secured. On the other hand, when the number of the specific range large-diameter particles is equal to or greater than 3% by number, uniformity of the white components in the fixed image is maintained and image density unevenness hardly occurs.

When the number of the specific range small-diameter particles is equal to or greater than 10% by number, the filler effect is likely to be exhibited in the surface layer portion. On the other hand, when the number of the specific range small-diameter particle is equal to or less than 50% by number, the deterioration of the meltability of the toner is likely to be prevented by the filler effect, and thus it likely to obtain a target minimum film formation temperature (MFT).

Ratio (surface layer portion/inner portion) of area occupancy ratio of specific range small-diameter particles to area occupancy ratio of specific range large-diameter particles in surface layer portion and inner portion of toner particle Then, the ratio (the concentration ratio) of the specific range small-diameter particles to the specific range large-diameter particles in a region positioned within 35% from the surface with respect to the diameter of the white toner particle (surface layer portion) and in a region positioned inside 35% from the surface with respect to the diameter of the white toner particle (inner portion) will be described.

The ratio of the area occupancy ratio (that is, the concentration) of the specific range small-diameter particles in the surface layer portion to the area occupancy ratio thereof in the inner portion of the toner particle is preferably the relationship satisfying "surface layer portion>inner portion". That is, it is preferable that the specific range small-diameter particles are unevenly distributed in the surface layer portion rather than the inner portion.

Moreover, the ratio (surface layer portion/inner portion) of the occupancy of the above-described specific range small-diameter particles in the toner particle is preferably in a range of 1/0.9 to 1/0.1, is further preferably in a range of 1/0.8 to 1/0.2, and is still further preferably in a range of 1/0.7 to 1/0.3.

When the ratio (surface layer portion/inner portion) is in the above-described range, the specific range small-diameter particles are unevenly distributed in the surface layer portion rather than the inner portion, and thus the filler effect of the specific range small-diameter particle is likely to be exhibited.

The ratio of the area occupancy ratio (that is, the concentration) of the specific range large-diameter particles in the surface layer portion to the area occupancy ratio thereof in the inner portion of the toner particle is preferably the relationship satisfying "surface layer portion<inner portion". That is, it is preferable that the specific range large-diameter particles are unevenly distributed in the inner portion rather than the surface layer portion.

Moreover, the ratio (surface layer portion/inner portion) of the occupancy ratio of the above-described specific range large-diameter particles in the toner particle is preferably in a range of 1/10 to 1/1.2, is further preferably in a range of 1/9 to 1/1.5, and is still further preferably in a range of 1/8 to 1/2.

When the ratio (surface layer portion/inner portion) is in the above-described range, the specific range large-diameter particles are unevenly distributed in the inner portion rather than the surface layer portion, and thus the deterioration of the contact area between the recording medium and the binder resin at the time of fixing is prevented by the influence of the specific range large-diameter particle present in the surface layer portion. With this, the fixing strength is likely to be secured.

The number average circle equivalent diameter A of the white pigment particles present in the entirety of the white toner particle, and the number average circle equivalent diameter B of the white pigment particles present in the surface layer portion of the white toner particle are calculated from an image obtained by observing cross section of the white toner particle.

First, a method of calculating the number average circle equivalent diameter A will be described.

The observation of the cross section of the white toner particle is confirmed, for example, by a method of observing with a scanning electron microscope (SEM) after performing staining with ruthenium tetroxide on a section of the white toner particle (or a white toner, the same applies hereinafter) As the scanning electron microscope, any type well known by those skilled in the art may be used, and examples thereof include SU8020 manufactured by Hitachi High-Technologies Corporation and JSM-7500 F manufactured by JEOL Ltd.

Specific observation method is as follows. First, the white toner particle to be measured is embedded in an epoxy resin, and then the epoxy resin is cured. The cured material is sliced with a microtome provided with a diamond blade to obtain an observation sample in which the cross section of white toner particle is exposed. The cross section of the white toner particle is observed with a scanning electron microscope by performing the staining with ruthenium tetroxide on an observation specimen of a flake. With such an observation method, in the cross section of the white toner particle, the white pigment particles having a luminance difference (contrast) in the continuous phase of the binder resin are observed due to the difference in dyeing degree.

The image of the observed white pigment particles is set in an image analyzer (LUZEXIII, manufactured by Nireco Corporation.), the area for each white pigment particle is measured by image analysis of the primary particles, and then the equivalent circle diameter is calculated from the value of the measured area. 50% of diameter at a cumulative frequency on the basis of the number of the obtained circle equivalent diameters is designated as the number average circle equivalent diameter A of the white pigment particles.

Here, regarding 50% of diameter at the cumulative frequency, the cumulative of the equivalent circle diameters is limited to be in a range of 16% to 84%, and the cumulative 50% equivalent circle diameter in the cumulative range of 16% to 84% is 50% is defined as the number average circle equivalent diameter A. Note that, the magnification of the electron microscope is adjusted such that 10 to 50 white pigment particles are photographed in one field of view, and then plural fields of view for the observation are combined so as to calculate the number equivalent circle diameter of the primary particle.

Note that, the number average circle equivalent diameter B is calculated from an image obtained by observing the cross section of the surface layer portion of the white toner particle with the same method as that used in the case of the number average circle equivalent diameter A.

In addition, "the area occupancy ratio of the specific range small-diameter particles in the surface layer portion or the specific range large-diameter particles", "the number of the specific range large-diameter particles or the number of the specific range small-diameter particles which are present in the entirety of the white toner particle", and "the number of the specific range large-diameter particles or the number of the specific range small-diameter particles present in the surface layer portion" are also calculated from the image obtained by observing the cross section of the white toner particle with the same method as described above.

Hereinafter, the configuration of the white toner according to the exemplary embodiment will be described in detail.

The white toner according to the exemplary embodiment contains a white toner particle, and may further contain an external additive. That is, in the exemplary embodiment, the toner particle may be used as toner, or the external additive which is external added to the toner particle may be used as toner.

White Toner Particle

The white toner particle in the exemplary embodiment contains the binder resin and the white pigment particle.

White Pigment Particle

Examples of the white pigment particle include titanium oxide ($TiO_2$), zinc oxide (ZnO, zinc white), calcium carbonate ($CaCO_3$), basic lead carbonate ($2PbCO_3Pb(OH)_2$, white lead), zinc sulfide-barium sulfate mixture (lithopone), zinc sulfide (ZnS), silicon dioxide ($SiO_2$, silica), and aluminum oxide ($Al_2O_3$, alumina).

Among the white pigment particles, titanium oxide and zinc oxide are preferable, and titanium oxide is further preferable. Note that, the titanium dioxide may be a rutile type, an anatase type, or an amorphous type.

The white pigment particle may be used alone or two or more thereof may be used in combination. Also, the white pigment may a pigment which is subjected to a surface treatment if necessary, or may be used together with a dispersion.

The total content of the white pigment particles in the white toner particle is preferably from 15% by weight to 70% by weight, and further preferably from 20% by weight to 60% by weight.

Binder Resin

Examples of the binder resin include vinyl resins formed of homopolymer of monomers such as styrenes (for example, styrene, para-chloro styrene, and α-methyl styrene), (meth)acrylic esters (for example, methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, laurylmethacrylate, and 2-ethylhexyl methacrylate), ethylenic unsaturated nitriles (for example, acrylonitrile, and methacrylonitrile), vinyl ethers (for example, vinyl methyl ether, and vinyl isobutyl ether), vinyl ketones (for example, vinyl methyl ketone, vinyl ethyl ketone, and vinyl isopropenyl ketone), and olefins (for example, ethylene, propylene, and butadiene), or copolymers obtained by combining two or more kinds of these monomers.

As the binder resin, there are also exemplified non-vinyl resins such as an epoxy resin, a polyester resin, a polyurethane resin, a polyamide resin, a cellulose resin, a polyether resin, and a modified rosin, a mixture thereof with the above-described vinyl resins, or a graft polymer obtained by polymerizing a vinyl monomer with the coexistence of such non-vinyl resins.

These binder resins may be used singly or in combination of two or more types thereof.

As the binder resin, the polyester resin is preferably used.

Examples of the polyester resin include a well-known amorphous polyester resin. As the polyester resin, the amorphous polyester resin and the crystalline polyester resin may be used in combination. Note that, the content of the crystalline polyester resin may be in a range of 2% by weight to 40% by weight (preferably in a range of 2% by weight to 20% by weight) with respect to the total amount of the binder resin.

Note that, "crystalline" of the resin means having a clear endothermic peak without endothermic change in a stepwise manner in the differential scanning calorimetry (DSC), and specifically, the half-value width of the endothermic peak is within 10° C. when measured at a heating rate of 10 (° C./min).

On the other hand, "amorphous" of the resin means that the half value width is higher than 10° C., the endothermic change is indicated in stepwise manner, or clear endothermic peak is not recognized.

Amorphous Polyester Resin

Examples of the amorphous polyester resin include a condensation polymer of a polyvalent carboxylic acid and a polyhydric alcohol. A commercially available product or a synthesized product may be used as the amorphous polyester resin.

Examples of the polyvalent carboxylic acid include aliphatic dicarboxylic acid (for example, oxalic acid, malonic acid, maleic acid, fumaric acid, citraconic acid, itaconic acid, glutaconic acid, succinic acid, alkenyl succinic acid, adipic acid, and sebacic acid), alicyclic dicarboxylic acid (for example, cyclohexane dicarboxylic acid), aromatic dicarboxylic acid (for example, terephthalic acid, isophthalic acid, phthalic acid, and naphthalene dicarboxylic acid), an anhydride thereof, or lower alkyl esters (having, for example, from 1 to 5 carbon atoms) thereof. Among these, for example, aromatic dicarboxylic acids are preferably used as the polyvalent carboxylic acid.

As the polyvalent carboxylic acid, tri- or higher-valent carboxylic acid employing a crosslinked structure or a branched structure may be used in combination together with dicarboxylic acid. Examples of the tri- or higher-valent carboxylic acid include trimellitic acid, pyromellitic acid, anhydrides thereof, or lower alkyl esters (having, for example, 1 to 5 carbon atoms) thereof.

The polyvalent carboxylic acids may be used singly or in combination of two or more types thereof.

Examples of the polyhydric alcohol include aliphatic diol (for example, ethylene glycol, diethylene glycol, triethylene glycol, propylene glycol, butanediol, hexanediol, and neopentyl glycol), alicyclic diol (for example, cyclohexanediol, cyclohexane dimethanol, and hydrogenated bisphenol A), aromatic diol (for example, an ethylene oxide adduct of bisphenol A, and a propylene oxide adduct of bisphenol A). Among these, for example, aromatic diols and alicyclic diols are preferably used, and aromatic diols are further preferably used as the polyhydric alcohol.

As the polyhydric alcohol, a tri- or higher-valent polyhydric alcohol employing a crosslinked structure or a branched structure may be used in combination together with diol. Examples of the tri- or higher-valent polyhydric alcohol include glycerin, trimethylolpropane, and pentaerythritol.

The polyhydric alcohol may be used singly or in combination of two or more types thereof.

The glass transition temperature (Tg) of the amorphous polyester resin is preferably in a range of 50° C. to 80° C., and is further preferably in a range of 50° C. to 65° C.

The glass transition temperature is obtained from a DSC curve obtained by differential scanning calorimetry (DSC).

More specifically, the glass transition temperature is obtained from "Extrapolated Glass Transition Onset Temperature" described in the method of obtaining a glass transition temperature in JIS K 7121-1987 "Testing Methods for Transition Temperatures of Plastics".

The weight average molecular weight (Mw) of the amorphous polyester resin is preferably in a range of 5,000 to 1,000,000, and is further preferably in a range of 7,000 to 500,000.

The number average molecular weight (Mn) of the amorphous polyester resin is preferably in a range of 2,000 to 100,000.

The molecular weight distribution Mw/Mn of the amorphous polyester resin is preferably in a range of 1.5 to 100, and is further preferably in a range of 2 to 60.

The weight average molecular weight and the number average molecular weight are measured by gel permeation chromatography (GPC). The molecular weight measurement by GPC is performed using GPC•HLC-8120 GPC, manufactured by Tosoh Corporation as a measuring device, Column TSK gel Super HM-M (15 cm), manufactured by Tosoh Corporation, and a THF solvent. The weight average molecular weight and the number average molecular weight are calculated based of a molecular weight calibration curve plotted from a monodisperse polystyrene standard sample from the results of the foregoing measurement.

A known preparing method is used to prepare the amorphous polyester resin. Specific examples thereof include a method of conducting a reaction at a polymerization temperature set to be in a range of 180° C. to 230° C., if necessary, under reduced pressure in the reaction system, while removing water or an alcohol generated during condensation.

When monomers of the raw materials are not dissolved or compatibilized under a reaction temperature, a high-boiling-point solvent may be added as a solubilizing agent to dissolve the monomers. In this case, a polycondensation reaction is conducted while distilling away the solubilizing agent. When a monomer having poor compatibility is present in a copolymerization reaction, the monomer having poor compatibility and an acid or an alcohol to be polycondensed with the monomer may be previously condensed and then polycondensed with the major component.

Preparing Method of White Toner

Regarding the white toner according to the exemplary embodiment, the white toner particle (hereinafter, also simply referred to as "toner particle") is prepared, and the toner particle may be used as the white toner, and an external additive which is externally added to the toner particle may be used as the white toner.

The toner particles may be prepared according to any one of a drying method (for example, a kneading and pulverizing method) and a wetting method (for example, an aggregation and coalescence method, a suspension polymerization method, and a dissolution suspension method). The preparing method of the toner particles is not particularly limited, and well-known method may be employed. Among them, the toner particles may be obtained according to the aggregation and coalescence method.

From the viewpoint that it is possible to obtain the white toner (toner particle) in a state where the relationship between the equivalent circle diameter A of the white pigment particles present in the entirety of the toner particle and the equivalent circle diameter B of the white pigment particles present in the surface layer portion of the toner particle satisfies A>B, the toner particle in the exemplary embodiment includes the following structures for example.

(1) Core/shell structure (core particle/first shell layer/second shell layer) structure formed of a core (core particle) containing a first binder resin and a large-diameter pigment particle (that is, a pigment particle having a number average circle equivalent diameter larger than that of a small-diameter pigment particle), a first shell layer which covers the surface of the core particle, and contains a second binder resin and a small-diameter pigment particle (that is, a pigment particle having a number average circle equivalent diameter smaller than that of the large-diameter pigment particle), and a second shell layer which covers the surface of the first shell layer, and contains a third binder resin without a pigment particle (2) Core/shell structure (core particle/first shell layer) formed of the core particle and the first shell layer in the above (1)

(3) Core/shell structure (core particle/shell layer) formed of the core particle in the above (1), and a shell layer formed from a masterbatch obtained by kneading a resin and a small-diameter pigment particle (4) Structure formed of particles containing a hydrophobic large-diameter pigment particle and a hydrophilic small-diameter pigment particle (that is, a structure is not the core/shell structure, but is formed of a single layer particle) In this structure, a relatively large amount of the hydrophilic small-diameter pigment particles are present in the surface layer portion of the toner particle, and a relatively large amount of the hydrophobic large-diameter pigment particles are present in the inner portion of the toner particle.

Hereinafter, examples of methods for preparing the toner particles of the above (1), (3) and (4) will be sequentially described.

A method of preparing the toner particle having the core/shell structure (core particle/first shell layer/the second shell layer) of above (1) will be described. The toner particle having the core/shell structure of above (1) is preferably prepared through the following steps according to, for example, an aggregation and coalescence method.

Specifically, it is preferable to prepare the toner particle through a step (dispersion preparing step) of preparing respective dispersions, a step (first aggregated particle forming step (core particle forming step)) of mixing a first resin particle dispersion in which first resin particles are dispersed, a large-diameter pigment particle dispersion in which large-diameter pigment particles are dispersed, and if necessary, a release agent particle dispersion in which particles of the release agent (hereinafter, also referred to as "release agent particle") are dispersed, with each other, and aggregating the respective particles in the obtained dispersion so as to form a first aggregated particle; a step (second aggregated particle forming step (core particle/first shell layer forming step)) of adding a second resin particle dispersion in which second resin particles are dispersed and a small-diameter pigment particle dispersion in which the small-diameter pigment particles are dispersed to the obtained first aggregated particle dispersion in which the first aggregated particles are dispersed, and further attaching the second resin particle and the small-diameter pigment particle on the surface of the first aggregated particle so as to form a second aggregated particle; a step (third aggregated particle forming step (core particle/first shell layer/second shell layer forming step)) of adding a third resin particle dispersion in which third resin particles are dispersed to the obtained second aggregated particle dispersion in which the second aggregated particles are dispersed, and further attaching the third resin particle on the surface of the second aggregated particle so as to form a third aggregated particle; and a step (coalescence step) of heating the third aggregated particle dispersion in which the third aggregated particles are dispersed, and coalescing the third aggregated particles so as to form a toner particle.

Hereinafter, the respective steps are will be described in detail.

Step of Preparing Respective Dispersions

Further, the respective dispersions used in the aggregation and coalescence method are prepared. Specifically, the first resin particle dispersion, the second resin particle dispersion, the third resin particle dispersion, and a white pigment particle dispersion (the large-diameter pigment particle dispersion, and the small-diameter pigment particle dispersion) are prepared, and the release agent particle dispersion is prepared if necessary.

Note that, in the step of preparing the respective dispersions, each of the resin particles is referred to as a "resin particle".

Here, the resin particle dispersion is, for example, prepared by dispersing the resin particles in a dispersion medium with a surfactant.

An aqueous medium is used, for example, as the dispersion medium used in the resin particle dispersion.

Examples of the aqueous medium include water such as distilled water, ion exchange water, or the like, alcohols, and the like. The medium may be used singly or in combination of two or more types thereof.

Examples of the surfactant include anionic surfactants such as sulfate, sulfonate, phosphate, and soap anionic surfactants; cationic surfactants such as amine salt and quaternary ammonium salt cationic surfactants; and nonionic surfactants such as polyethylene glycol, alkyl phenol ethylene oxide adduct, and polyhydric alcohol. Among them, anionic surfactants and cationic surfactants are particularly preferable. Nonionic surfactants may be used in combination with anionic surfactants or cationic surfactants.

The surfactants may be used singly or in combination of two or more types thereof.

Regarding the resin particle dispersion, as a method of dispersing the resin particles in the dispersion medium, a common dispersing method using, for example, a rotary shearing-type homogenizer, or a ball mill, a sand mill, or a Dyno mill as media is exemplified. Depending on the type of the resin particles, the resin particles may be dispersed in the resin particle dispersion using, for example, a phase inversion emulsification method.

The phase inversion emulsification method includes: dissolving a resin to be dispersed in a hydrophobic organic solvent in which the resin is soluble; conducting neutralization by adding a base to an organic continuous phase (Ophase); and converting the resin (so-called phase inversion) from W/O to O/W by adding an aqueous medium (W phase) to form a discontinuous phase, thereby dispersing the resin as particles in the aqueous medium.

The volume average particle diameter of the resin particles dispersed in the resin particle dispersion is, for example, preferably in a range of 0.01 μm to 1 μm, further preferably in a range of 0.08 μm to 0.8 μm, and still further preferably in a range of 0.1 μm to 0.6 μm.

Regarding the volume average particle diameter of the resin particles, a cumulative distribution by volume is drawn from the side of the smallest diameter with respect to particle diameter ranges (channels) separated using the particle diameter distribution obtained by the measurement of a laser diffraction-type particle diameter distribution measuring device (for example, manufactured by Horiba, Ltd., LA-700), and a particle diameter when the cumulative percentage becomes 50% with respect to the entirety of the particles is measured as a volume average particle diameter D50v. The volume average particle diameter of the particles in the other dispersions is also measured in the same manner.

The content of the resin particles contained in the resin particle dispersion is, for example, preferably in a range of 5% by weight to 50% by weight, and further preferably in a range of 10% by weight to 40% by weight.

For example, the release agent particle dispersion is also prepared in the same manner as in the case of the resin particle dispersion. That is, the resin particles in the resin particle dispersion are the same as the particles of the release agent particle dispersed in the release agent particle dispersion, in terms of the volume average particle diameter, the dispersion medium, the dispersing method, and the content of the particles in the resin particle dispersion.

Here, the method of preparing the white pigment particle dispersion (the large-diameter pigment particle dispersion and the small-diameter pigment particle dispersion) will be described.

The white pigment particle dispersion is preferably obtained by mixing at least two types of white pigment particle dispersions in which the average circle equivalent diameters are different from each other. In the exemplary embodiment, a method of preparing two types of dispersions will be described. The two types of dispersions include the large-diameter pigment particle dispersion containing the pigment particle in which the number average circle equivalent diameter is larger than that of the small-diameter pigment particle in the following small-diameter pigment particle dispersion, and the small-diameter pigment particle dispersion containing the pigment particle in which the number average circle equivalent diameter is smaller than that of the large-diameter pigment particle in the large-diameter pigment particle dispersion.

First, similar to the above-described resin particle dispersion, white pigment particle dispersion (hereinafter, also referred to as a "pre-white pigment particle dispersion") is prepared. That is, the resin particles in the resin particle dispersion are the same as the white pigment particles which are dispersed in the pre-white pigment particle dispersion, in terms of the volume average particle diameter, the dispersion medium, the dispersing method, and the content of the particles in the resin particle dispersion.

Then, the dispersion medium and the surfactant are added to the pre-white pigment particle dispersion so as to form a mixed dispersion, and the white pigment particles in the mixed dispersion are further dispersed by stirring the mixed dispersion. Note that, examples of the dispersion medium and the surfactant include the same materials as described above.

After that, the mixed dispersion is separated into the small-diameter pigment particle dispersion and the large-diameter pigment particle dispersion, for example, with a centrifugal machine. Specifically, the method of separating the mixed dispersion include a method in which after performing a centrifugation treatment, the supernatant of the mixed dispersion is collected so as to obtain the small-diameter pigment particle dispersion, and the remaining liquid is collected so as to obtain a large-diameter pigment particle dispersion.

Note that, examples of the method of dispersing the white pigment particles in the mixed dispersion include a method of dispersing the particles with a high pressure type homogenizer, a rotary shearing type homogenizer, an ultrasonic dispersing machine, and a high pressure impact type dispersing machine.

First Aggregated Particle Forming Step (Core Particle Forming Step)

Next, the first resin particle dispersion, the large-diameter pigment particle dispersion, and if necessary, the release agent particle dispersion are mixed with each other.

Then, the first resin particles and the large-diameter pigment particles (and the release agent particle if necessary) are heterogeneously aggregated in the mixed dispersion, thereby forming the first aggregated particle.

Specifically, for example, an aggregating agent is added to the mixed dispersion and a pH of the mixed dispersion is adjusted to be acidic (for example, the pH is from 2 to 5).

If necessary, a dispersion stabilizer is added. Then, the mixed dispersion is heated at a temperature of a glass transition temperature of the first resin particles (specifically, for example, in a range of glass transition temperature of −30° C. to glass transition temperature of −10° C. of the first resin particles) to aggregate the particles dispersed in the mixed dispersion, thereby forming a first aggregated particle.

In the first aggregated particle forming step, for example, the aggregating agent may be added at room temperature (for example, 25° C.) while stirring of the mixed dispersion using a rotary shearing-type homogenizer, the pH of the mixed dispersion may be adjusted to be acidic (for example, the pH is from 2 to 5), a dispersion stabilizer may be added if necessary, and then the heating may be performed.

Examples of the aggregating agent include a surfactant having an opposite polarity to the polarity of the surfactant used as the dispersing agent to be added to the mixed dispersion, an inorganic metal salt, a divalent or more metal complex. Particularly, when a metal complex is used as the aggregating agent, the amount of the surfactant used is reduced and charging characteristics are improved.

An additive for forming a bond of metal ions as the aggregating agent and a complex or a similar bond may be used, if necessary. A chelating agent is suitably used as this additive.

Examples of the inorganic metal salt include metal salt such as calcium chloride, calcium nitrate, barium chloride, magnesium chloride, zinc chloride, aluminum chloride, and aluminum sulfate, and an inorganic metal salt polymer such as poly aluminum chloride, poly aluminum hydroxide, and calcium polysulfide.

As the chelating agent, an aqueous chelating agent may be used. Examples of the chelating agent include oxycarboxylic acid such as tartaric acid, citric acid, and gluconic acid, iminodiacetic acid (IDA), nitrilotriacetic acid (NTA), and ethylenediaminetetraacetic acid (EDTA).

The additive amount of the chelating agent is, for example, preferably in a range of 0.01 parts by weight to 5.0 parts by weight, and is further preferably equal to or greater than 0.1 parts by weight and less than 3.0 parts by weight, with respect to 100 parts by weight of first resin particles.

Second Aggregated Particle Forming Step (Core Particle/First Shell Layer Forming Step)

Method of Forming First Shell Layer (First Aspect)

Next, after obtaining the first aggregated particle dispersion in which the first aggregated particles are dispersed, the second resin particle dispersion in which the second resin particles are dispersed, and the small-diameter pigment particle dispersion in which the small-diameter pigment particles are dispersed are added to the first aggregated particle dispersion.

Note that, the second resin particle may be the same type as or different from that of the first resin particle.

In addition, in the dispersion in which the first aggregated particle, the second resin particle, and the small-diameter pigment particle are dispersed, the second resin particle and the small-diameter pigment particle are attached on the surface of the first aggregated particle. Specifically, for example, in the first aggregated particle forming step, when the first aggregated particle has a target particle diameter, the second resin particle dispersion and the small-diameter pigment particle dispersion are added to the first aggregated particle dispersion, and the obtained dispersion is heated at a temperature of equal to or lower than the glass transition temperature of the second resin particle.

Through the step, a second aggregated particle in which the second resin particle and the small-diameter pigment particle are attached on the surface of the first aggregated particle is formed.

With this, it is possible to obtain the toner particle containing the large-diameter pigment particle as the core particle, and the small-diameter pigment particle as the first shell layer. That is, it is possible to obtain the toner particles in a state where the relationship between the equivalent circle diameter A of the white pigment particle present in the entirety of the toner particle and the equivalent circle diameter B of the white pigment particle present in the surface layer portion of the toner particle satisfies A>B.

Here, when the second resin particle dispersion and the small-diameter pigment particle dispersion are added to the first aggregated particle dispersion, a dispersion state of the small-diameter pigment particles into the first shell layer is controlled by changing 1) addition place, 2) addition timing, 3) addition rate, and 4) concentration of the small-diameter pigment particles in the mixed dispersion. In other words, it is likely to obtain the toner particles in which the relationship between the equivalent circle diameter A of the white pigment particles present in the entirety of the toner particle and the equivalent circle diameter B of the white pigment particles present in the surface layer portion of the toner particle satisfies A>B, and the area occupancy ratio of the specific range small-diameter particles (the pigment particle having an equivalent circle diameter in a range of 10 nm to 100 nm) in the surface layer portion of the toner particle, the number (% by number) of the specific range small-diameter particles present in the entirety of the toner particle, and the number (% by number) of the specific range small-diameter particles present in the surface layer portion are controlled in a specific range.

Method of Forming First Shell Layer (Second Aspect)

In the first aspect, the method of forming the first shell layer by adding and aggregating the second resin particle dispersion and the small-diameter pigment particle dispersion into the first aggregated particle dispersion in which the first aggregated particles are dispersed is shown. However, a method of adding the second resin particle dispersion, the small-diameter pigment particle dispersion, and the large-diameter pigment particle dispersion at the time of forming the first shell layer, and slowly changing the concentration of the small-diameter pigment particles and the large-diameter pigment particles in the dispersion may be used.

The method of adding the second resin particle dispersion, the small-diameter pigment particle dispersion, and the large-diameter pigment particle dispersion at the time of forming the first shell layer, and slowly changing the concentration of the small-diameter pigment particles and the large-diameter pigment particles is not particularly limited, and a power feeding addition method may be used. With the power feeding addition method, it is possible to add the first aggregated particle dispersion to each dispersion by controlling 1) addition place, 2) addition timing, 3) addition rate, and 4) concentration of the small-diameter pigment particles in the mixed dispersion.

Hereinafter, a method of adding the mixed dispersion according to the power feeding addition method will be described with reference to the drawings.

FIG. 1 illustrates an apparatus used in the power feeding addition method. Note that, in FIG. 1, a reference numeral 311 is denoted as a first aggregated particle dispersion, a reference numeral 312 is denoted as a large-diameter particle-containing dispersion which contains a large-diameter pigment particle dispersion and a second resin particle dispersion, and a reference numeral 313 is denoted as a small-diameter pigment particle dispersion.

The apparatus as illustrated in FIG. 1 is provided with a first storage tank 321 which stores the first aggregated particle dispersion in which the first aggregated particles are dispersed, a second storage tank 322 which stores the large-diameter particle-containing dispersion, and a third storage tank 323 which stores the small-diameter pigment particle dispersion in which the small-diameter pigment particles are dispersed.

The first storage tank 321 and the second storage tank 322 are connected to each other via a first liquid supply pipe 331. A first liquid supply pump 341 is interposed in the middle of a path of the first liquid supply pipe 331. In accordance with the driving of the first liquid supply pump 341, the dispersion stored in the second storage tank 322 is supplied to the first storage tank 321 in which the first aggregated particle dispersion is stored through the first liquid supply pipe 331.

The first storage tank 321 is provided with a first stirrer 351. When the dispersion stored in the second storage tank 322 is supplied to the first storage tank 321 in which the first aggregated particle dispersion is stored, the respective dispersions in the first storage tank 321 are stirred and mixed in accordance with the driving of the first stirrer 351.

The second storage tank 322 and the third storage tank 323 are connected to each other via a second liquid supply pipe 332. A second liquid supply pump 342 is interposed in the middle of the second liquid supply pipe 332. In accordance with the driving of the second liquid supply pump 342, the dispersion stored in the third storage tank 323 is supplied to the second storage tank 322 in which the dispersion is stored through the second liquid supply pipe 332.

The second storage tank 322 is provided with a second stirrer 352. When the dispersion stored in the third storage tank 323 is supplied to the second storage tank 322 in which the large-diameter pigment particle dispersion and the resin particle dispersion are stored, the respective dispersions in the second storage tank 322 are stirred and mixed with each other in accordance with the driving of the second stirrer 352.

In the apparatus as illustrated in FIG. 1, first, the first aggregated particle dispersion is prepared through the first aggregated particle forming step in the first storage tank 321, and the first aggregated particle dispersion is stored in the first storage tank 321. Note that, the first aggregated particle dispersion may be prepared through the first aggregated particle forming step in another tank, and then the first aggregated particle dispersion may be stored in the first storage tank 321.

In this state, the first liquid supply pump 341 and the second liquid supply pump 342 are driven.

Next, the small-diameter pigment particle dispersion stored in the third storage tank 323 is supplied to the second storage tank 322 in which the large-diameter particle-containing dispersion containing the large-diameter pigment particle dispersion and the second resin particle dispersion is stored. Further, the respective dispersions are stirred and mixed with each other in the second storage tank 322 in accordance with the driving of the second stirrer 352.

At this time, the small-diameter pigment particle dispersion is sequentially supplied to the second storage tank 322 in which the large-diameter particle-containing dispersion is stored, and thus the concentration of the small-diameter pigment particle is slowly increased. For this reason, the mixed dispersion in which the large-diameter pigment particle, the second resin particle, and the small-diameter pigment particle are dispersed, is stored in the second storage tank 322, and the mixed dispersion is supplied to the first storage tank 321 in which the first aggregated particle dispersion is stored. In addition, the respective dispersions are stirred and mixed with each other in the first storage tank 321 in accordance with the driving of the first stirrer 351.

In such a power feeding addition method, by changing a discharge position of the first liquid supply pipe 331, it is possible to change a location, to which the dispersion is supplied, from the second storage tank 322 to the first storage tank 321. That is, it is possible to change a location where the mixed dispersion in which the large-diameter pigment particle, the second resin particle, and the small-diameter pigment particle are dispersed is added to the first aggregated particle dispersion.

In addition, it is possible to change the timing of the dispersion supply from the second storage tank 322 to the first storage tank 321 by changing the driving timing of the first liquid supply pump 341. That is, it is possible to change the timing of the addition of the mixed dispersion in which the large-diameter pigment particle, the second resin particle, and the small-diameter pigment particle are dispersed to the first aggregated particle dispersion.

In addition, it is possible to change the amount of the dispersion supplied from the second storage tank 322 to the first storage tank 321 by changing an output of the first liquid supply pump 341. That is, it is possible to change the speed of the addition of the mixed dispersion in which the large-diameter pigment particle, the second resin particle, and the small-diameter pigment particle are dispersed to first aggregated particle dispersion.

Further, it is possible to change the amount of the dispersion supplied form the third storage tank 323 to the second storage tank 322 by changing an output of the second liquid supply pump 342. That is, it is possible to change the concentration of the small-diameter pigment particle in the dispersion (in the mixed dispersion) supplied from the second storage tank 322 to the first storage tank 321.

Accordingly, with the power feeding addition method, it is possible to add to the first aggregated particle dispersion in the mixed dispersion by controlling 1) addition place, 2) addition timing, 3) addition rate, and 4) concentration of the small-diameter pigment particles in the mixed dispersion.

Note that, the above-described power feeding addition method is not limited to the above-described method. Various methods may be employed, for example, a method in which 1) a storage tank which stores the second resin particle dispersion, a storage tank which stores the large-diameter pigment particle dispersion, and a storage tank which stores the mixed dispersion in which the large-diameter pigment particle and the small-diameter pigment particle are dispersed are separately provided, and the respective dispersions are supplied to the first storage tank 321 may be employed.

As described above, it is possible to obtain the second aggregated particle obtained by aggregating the second resin particle and the small-diameter pigment particle in a state of being attached on the surface of the first aggregated particle (first aspect), or the second aggregated particle obtained by aggregating the second resin particle, the small-diameter pigment particle, and the large-diameter pigment particle in a state of being attached on the surface of the first aggregated particle (second aspect).

Third Aggregated Particle Forming Step (Core Particle/First Shell Layer/Second Shell Layer Forming Step)

Next, after obtaining the second aggregated particle dispersion in which the second aggregated particles are dispersed, the third resin particle dispersion in which the third resin particles are dispersed is further added to the second aggregated particle dispersion.

Note that, the third resin particle may the same type as or different from that of the first resin particle and second resin particle.

The third resin particle is attached on the surface of the second aggregated particle in the dispersion in which the second aggregated particle and the third resin particle are dispersed. Specifically, for example, in the second aggregated particle forming step, when the second aggregated particle has a target particle diameter, the third resin particle dispersion is added to the second aggregated particle dispersion, and the obtained dispersion is heated at a temperature of equal to or lower than the glass transition temperature of the third resin particle.

In addition, the progress of aggregation is stopped by adjusting pH of the dispersion to be in a range of 6.5 to 8.5.

Coalescence Step

Next, the third aggregated particle dispersion in which the third aggregated particles are dispersed is heated at a temperature of equal to or higher than the glass transition temperature of the first to third resin particles (for example, a temperature of equal to or higher than the glass transition temperature of the first to third resin particles by the range of 10° C. to 30° C.), and then the third aggregated particles are subjected to the coalescence.

Through the steps, it is possible to obtain the toner particles.

Note that, the third aggregated particle forming step may not be performed. With this, it is possible to obtain the toner particle having the core/shell structure (the core/shell structure in the above (2)) formed of the core (core particle) and the first shell layer.

After completing the coalescence step, the toner particles formed in the solution are subjected to a washing step, a solid-liquid separation step, and a drying step, that are well known, and thus dry toner particles are obtained.

In the washing step, displacement washing using ion exchange water may be sufficiently performed from the viewpoint of charging properties. In addition, the solid-liquid separation step is not particularly limited, but suction filtration, pressure filtration, or the like is preferably performed from the viewpoint of productivity. The method of the drying step is also not particularly limited, but freeze drying, airflow drying, fluidized drying, vibration-type fluidized drying, or the like may be performed from the viewpoint of productivity.

The toner according to the exemplary embodiment is prepared by adding and mixing, for example, an external additive to the obtained dry toner particles. The mixing may be performed with, for example, a V-blender, a Henschel mixer, a Lodige mixer, or the like. Furthermore, if necessary, coarse particles of the toner may be removed with a vibration sieving machine, a wind classifier, or the like.

Next, a method of preparing the toner particle having the core/shell structure (core particle/shell layer) of the above (3) will be described.

The toner particle having the core/shell structure of the above (3) is preferably prepared through the following steps according to the kneading pulverization method and the aggregation and coalescence method in combination.

First, the resin and the small-diameter pigment particle are kneaded so as to form a masterbatch containing the resin and the small-diameter pigment particle.

The average particle diameter of the small-diameter pigment particles in the masterbatch is preferably, for example, in a range of 10 nm to 200 nm, is further preferably in a range of 20 nm to 150 nm, and is still further preferably in a range of 25 nm to 130 nm.

Then, a masterbatch dispersion (hereinafter, also referred to as a "shell layer forming dispersion") for forming a shell layer in which the masterbatch is dispersed in the dispersion medium is prepared.

The masterbatch is attached on the surface of the first aggregated particle obtained by the method of preparing the toner particle of the above (1) by using the shell layer forming dispersion so as to form the second aggregated particle.

After that, the aggregated particle dispersion in which the second aggregated particles are dispersed is heated, and the second aggregated particles are subjected to the coalescence so as to obtain the toner particle. Note that, the toner particle may be obtained by forming the third aggregated particle by aggregating the resin particles in a state of being further attached on the surface of the second aggregated particle, and then subjecting the coalescence to the third aggregated particle.

After completing the coalescence step, the toner particle and the toner are obtained in the same manner as in the above (1).

Next, a method of preparing the toner particle having the structure formed of particles containing the hydrophobic large-diameter pigment particle and the hydrophilic small-diameter pigment particle (that is, a structure is not the core/shell structure, but is formed of a single layer particle) of the above (4) will be described.

The toner particle having the core structure of the above (4) is preferably prepared through the following steps according to, for example, the aggregation and coalescence method, for example.

Specifically, it is preferable to prepare the toner particle through a step (dispersion preparing step) of preparing respective dispersions, a step of (aggregated particle forming step) of mixing the resin particle dispersion in which the resin particles are dispersed, the small-diameter pigment particle dispersion in which the hydrophilic small-diameter pigment particles are dispersed, the large-diameter pigment particle dispersion in which the hydrophobic large-diameter pigment particles are dispersed, and if necessary, the release agent particle dispersion in which the release agent particles are dispersed, with each other, and aggregating the respective particles in the obtained dispersion so as to form the aggregated particle, and a step (coalescence step) of heating the aggregated particle dispersion in which the aggregated particles are dispersed, and coalescing the aggregated particles so as to form a toner particle.

Hereinafter, the respective steps are will be described in detail.

Step of Preparing Respective Dispersions

Specifically, the resin particle dispersion, the hydrophilic small-diameter pigment particle dispersion (which is the same as the above-described small-diameter pigment particle dispersion), the hydrophobic large-diameter pigment particle dispersion, and if necessary, the release agent particle dispersion are prepared.

Note that, the resin particle dispersion and the small-diameter pigment particle dispersion (if necessary, the release agent particle dispersion) may be prepared similar to the dispersion prepared in the above (1).

The hydrophobic large-diameter pigment particle dispersion is prepared according to the following method.

First, a white pigment particle of which the surface is subjected to an organic treatment is prepared. Note that, a method of performing the organic treatment on the surface of the white pigment particle is not particularly limited, and well-known methods may be employed. Examples thereof include a method of coating the surface of the white pigment particle with a treatment agent such as polyol, alkanolamine, and silicon by a wet treatment or a dry treatment. In addition, after the surface treatment of the surface of the white pigment particle with inorganic metal such as alumina, silica, amorphous hydrous titanium oxide, and combinations thereof, the organic treatment may be further performed thereon.

After that, the hydrophobic large-diameter pigment particle dispersion is obtained in the same manner as in the case of the large-diameter pigment particle dispersion obtained in the above (1).

Aggregated Particle Forming Step

The resin particle dispersion, the hydrophilic small-diameter pigment particle dispersion, the hydrophobic large-diameter pigment particle dispersion, and if necessary, the release agent particle dispersion are mixed with each other.

The resin particles, the hydrophilic small-diameter pigment particles, and the hydrophobic large-diameter pigment particles (and the release agent particle if necessary) are heterogeneously aggregated in the mixed dispersion, thereby forming the aggregated particle.

After forming the aggregated particle, pH of the dispersion in which the aggregated particles are dispersed may be adjusted in a range of 6.0 to 8.0 (further preferably in a range of 6.5 to 7.5). With this, it is likely that a large amount of the hydrophilic small-diameter pigment particles are present in the surface layer portion, and a large amount of the hydrophobic large-diameter pigment particles are present in the inner portion of the toner particle.

Coalescence Step

Next, the aggregated particle dispersion in which the aggregated particles are dispersed is heated at a temperature of equal to or higher than the glass transition temperature of the resin particle (for example, a temperature of equal to or higher than the glass transition temperature of the resin particle by the range of 10° C. to 30° C.) and then the aggregated particles are subjected to the coalescence. Note that, the shell layer may be formed by aggregating the resin particles in a state of being further attached on the surface of the aggregated particle.

After completing the coalescence step, the toner particle and the toner are obtained in the same manner as in the above (1).

Through the steps, it is possible to obtain the toner particles in a state where the relationship between the equivalent circle diameter A of the white pigment particles present in the entirety of the toner particle and the equivalent circle diameter B of the white pigment particle present in the surface layer portion of the toner particle satisfies A>B. The mechanism by which such toner particles are obtained is presumed as follows.

After forming the aggregated particle, when pH of the dispersion is adjusted to be low (for example, pH in a range of 6.0 to 8.0), the resin tends to be hydrophobic pH as compared with the case where a pH value is high, which changes the affinity with the hydrophobic large-diameter pigment particles. More specifically, after forming the aggregated particle, the surface of the toner particle contains a large amount of moisture, and thus the white pigment particles are likely to be present in the inner portion rather than the surface side of the toner particle. When the coalescence proceeds, the moisture is removed from the surface side of the toner particle, and the resin is softened, and thereby the white pigment particles are also likely to be moved by the thermal motion and diffusion. At this time, as compared with the hydrophobic large-diameter pigment particles, the hydrophilic small-diameter pigment particles are likely to be discharged to the surface side of the toner particle. In addition, since the hydrophobic large-diameter pigment particles have a large diameter, the movement thereof is slow, and thus the movement of the hydrophilic small-diameter pigment particles becomes relatively fast. With this, the obtained toner particle has a structure in which the small amount of the hydrophobic large-diameter pigment particles are present in the surface layer portion (that is, the ratio of the hydrophilic small-diameter pigment particles to the hydrophobic large-diameter pigment particles is increased in the surface layer portion). As a result, it is possible to obtain the toner particles satisfying the relationship expressed by A>B.

Electrostatic Charge Image Developer

The electrostatic charge image developer in the exemplary embodiment includes at least the toner in the exemplary embodiment.

The electrostatic charge image developer in the exemplary embodiment may be a one-component developer including only the toner in the exemplary embodiment, or may be a two-component developer including the toner and the carrier in the exemplary embodiment.

The carrier is not particularly limited, and a well-known carrier may be used. Examples of the carrier include a coating carrier in which the surface of the core formed of magnetic particles is coated with the coating resin; a magnetic particle dispersion-type carrier in which the magnetic particles are dispersed and distributed in the matrix resin; and a resin impregnated-type carrier in which a resin is impregnated into the porous magnetic particles.

Note that, the magnetic particle dispersion-type carrier and the resin impregnated-type carrier may be a carrier in which the particles forming the carrier are set as a core and the core is coated with the coating resin.

Examples of the magnetic particles include a magnetic metal such as iron, nickel, and cobalt, and a magnetic oxide such as ferrite, and magnetite.

Examples of the conductive particles include particles of metals such as gold, silver, and copper, carbon black, titanium oxide, zinc oxide, tin oxide, barium sulfate, aluminum borate, and potassium titanate.

Examples of the coating resin and the matrix resin include a straight silicone resin formed by containing polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic acid ester copolymer, and an organosiloxane bond, or the modified products thereof, a fluororesin, polyester, polycarbonate, a phenol resin, and an epoxy resin.

Note that, other additives such as the conductive particles may be contained in the coating resin and the matrix resin.

Examples of the conductive particle include metal such as gold, silver, and copper, carbon black, titanium oxide, zinc oxide, tin oxide, barium sulfate, aluminum borate, and potassium titanate.

Here, in order to coat the surface of the core with the coating resin, a method of coating the surface with a coating layer forming solution in which the coating resin, and various additives if necessary are dissolved in a proper solvent is used. The solvent is not particularly limited as long as a solvent is selected in consideration of a coating resin to be used and coating suitability.

Specific examples of the resin coating method include a dipping method of dipping the core into the coating layer forming solution, a spray method of spraying the coating layer forming solution onto the surface of the core, a fluid-bed method of spraying the coating layer forming solution to the core in a state of being floated by the fluid air, and a kneader coating method of mixing the core of the carrier with the coating layer forming solution and removing a solvent in the kneader coater.

The mixing ratio (weight ratio) of the toner to the carrier in the two-component developer is preferably in a range of toner:carrier=1:100 to 30:100, and is further preferably in a range of 3:100 to 20:100.

Image Forming Apparatus and Image Forming Method

An image forming apparatus and an image forming method according to this exemplary embodiment will be described.

The image forming apparatus according to the exemplary embodiment is provided with an image holding member, a charging unit that charges the surface of the image holding member, an electrostatic charge image forming unit that forms an electrostatic charge image on the charged surface of the image holding member, a developing unit that accommodates an electrostatic charge image developer, and develops the electrostatic charge image formed on the surface of the image holding member as a toner image by using the electrostatic charge image developer, a transfer unit that transfers the toner image formed on the surface of the image holding member to a surface of a recording medium, and a fixing unit that fixes the toner image transferred onto the surface of the recording medium. In addition, the electrostatic charge image developer according to the exemplary embodiment is used as the electrostatic charge image developer.

In the image forming apparatus according to the exemplary embodiment, an image forming method (the image forming method according to the exemplary embodiment) including a step of charging a surface of an image holding member, a step of forming an electrostatic charge image on the charged surface of the image holding member, a step of developing an electrostatic charge image formed on the surface of the image holding member as a toner image with the electrostatic charge image developer according to the exemplary embodiment, a step of transferring the toner image formed on the surface of the image holding member to a surface of a recording medium, and a step of fixing the toner image transferred to the surface of the recording medium is performed.

As the image forming apparatus according to the exemplary embodiment, well-known image forming apparatuses such as an apparatus including a direct-transfer type apparatus that directly transfers the toner image formed on the surface of the image holding member to the recording medium; an intermediate transfer type apparatus that primarily transfers the toner image formed on the surface of the image holding member to a surface of an intermediate transfer member, and secondarily transfers the toner image transferred to the intermediate transfer member to the surface of the recording medium; an apparatus including a cleaning unit that cleans the surface of the image holding member before being charged and after transferring the toner image; and an apparatus including an erasing unit that erases charges by irradiating the surface of the image holding member with erasing light before being charged and after transferring the toner image are applied.

In a case where the intermediate transfer type apparatus is used, the transfer unit is configured to include an intermediate transfer member that transfers the toner image to the surface, a primary transfer unit that primarily transfers the toner image formed on the surface of the image holding member to the surface of the intermediate transfer member, and a secondary transfer unit the toner image formed on the surface of the intermediate transfer member is secondarily transferred to the surface of the recording medium.

In the image forming apparatus according to the exemplary embodiment, for example, a unit including the developing unit may be a cartridge structure (process cartridge) detachable from the image forming apparatus. As a process cartridge, for example, a process cartridge including the developing unit accommodating the electrostatic charge image developer in the exemplary embodiment is preferably used.

The image forming apparatus according to the exemplary embodiment further may be an image forming apparatus which uses at least one selected from the group consisting of a yellow toner, a magenta toner, a cyan toner, and a black toner in addition to a white toner according to the exemplary embodiment.

Hereinafter, an example of the image forming apparatus of the exemplary embodiment will be described; however, the invention is not limited thereto. Note that, in the drawing, major portions will be described, and others will not be described.

Figure 2:
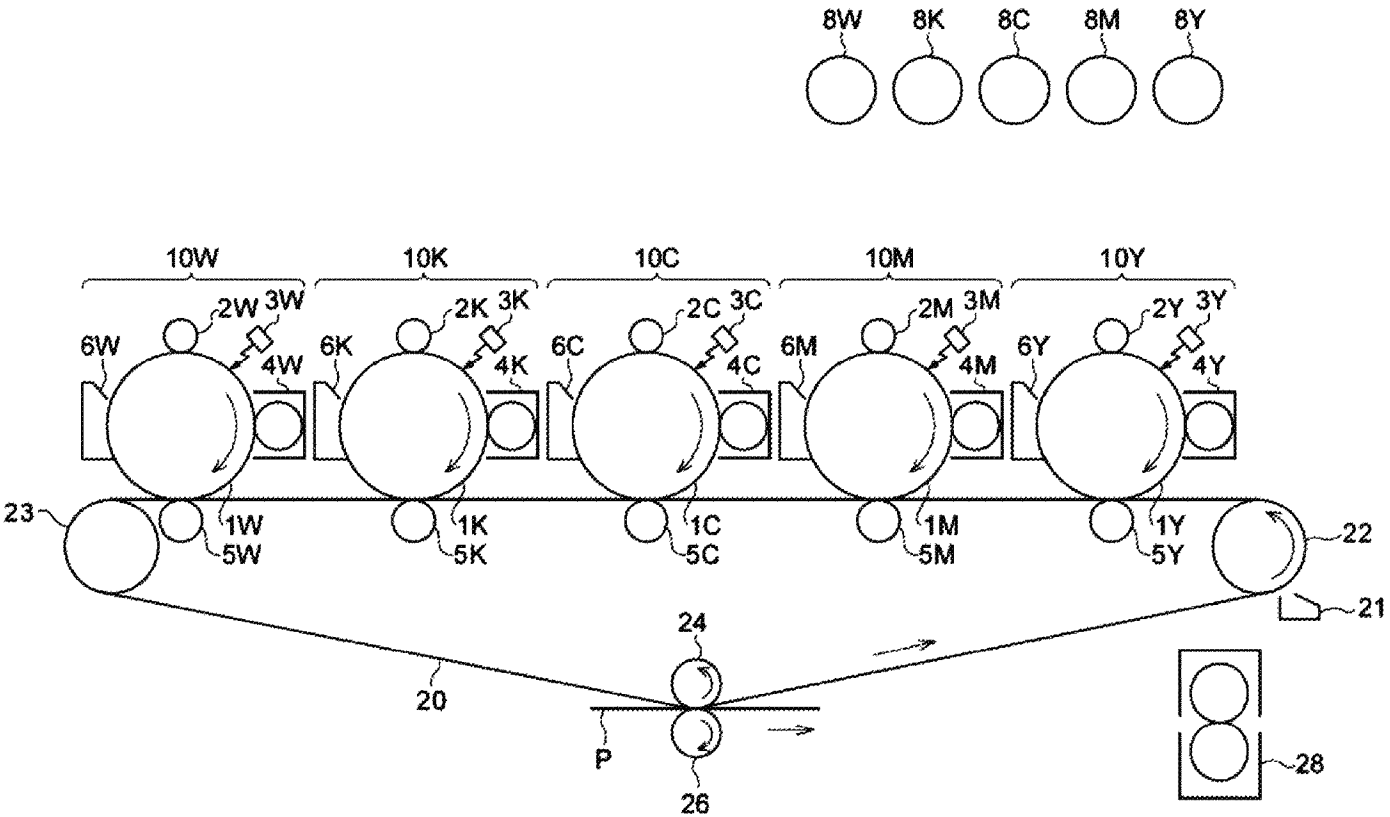
FIG. 2 is a configuration diagram illustrating an image forming apparatus according to the exemplary embodiment.

FIG. 2 is a configuration diagram illustrating the image forming apparatus according to the exemplary embodiment, and is a diagram illustrating an image forming apparatus of a 5-tandem tandem type and an intermediate transfer type.

The image forming apparatus as illustrated in FIG. 2 is provided with electrophotographic type first to fifth image forming units 10Y, 10M, 10C, 10K, and 10W (image forming unit) that output an image for each color of yellow (Y), magenta (M), cyan (C), black (K), and white (W) based on color separated image data. These image forming units 10Y, 10M, 10C, 10K, and 10W (hereinafter, simply referred to as a "unit" in some cases) are arranged apart from each other by a predetermined distance in the horizontal direction. Note that, the units 10Y, 10M, 10C, 10K, and 10W may be the process cartridge which is detachable from the image forming apparatus.

An intermediate transfer belt (an example of the intermediate transfer member) 20 passing through the respective units is extended downward the respective units 10Y, 10M, 10C, 10K, and 10W. The intermediate transfer belt 20 is provided to be wound by a driving roller 22, a supporting roller 23, and a facing roller 24 which contact the inner surface of the intermediate transfer belt 20, and travels to the direction from the first unit 10Y to the fifth unit 10W. Further, an intermediate transfer member cleaning device 21 is provided on the image holding surface side of the intermediate transfer belt 20 so as to face the driving roller 22.

A yellow toner, a magenta toner, a cyan toner, a black toner, and a white toner accommodated in toner cartridges 8Y, 8M, 8C, 8K, and 8W respectively are supplied to developing devices (an example of the developing unit) 4Y, 4M, 4C, 4K, 4W of the units 10Y, 10M, 10C, 10K, and 10W are supplied with.

The first to fifth units 10Y, 10M, 10C, 10K, and 10W have the same configuration, operation, and action as each other, and thus the first unit 10Y for forming a yellow image disposed on the upstream side of the travel direction of the intermediate transfer belt will be representatively described.

The first unit 10Y includes a photoreceptor 1Y serving as an image holding member. In the vicinity of the photoreceptor 1Y, a charging roller (an example of the charging unit) 2Y which charges the surface of the photoreceptor 1Y with a predetermined potential, an exposure device (an example of the electrostatic charge image forming unit) 3Y which exposes the charged surface with a laser beam based on color separated image signal so as to form an electrostatic charge image, a developing device (an example of the developing unit) 4Y which supplies the charged toner to the electrostatic charge image and develops the electrostatic charge image, a primary transfer roller 5Y (an example of the primary transfer unit) which transfers the developed toner image onto the intermediate transfer belt 20, and a photoreceptor cleaning device (an example of the cleaning unit) 6Y which removes the toners remaining on the surface of the photoreceptor 1Y after primary transfer are sequentially disposed.

The primary transfer roller 5Y is disposed inside the intermediate transfer belt 20, and is provided at a position facing the photoreceptor 1Y. A bias power supply (not shown) which applies the primary transfer bias is connected to each of the primary transfer rollers 5Y, 5M, 5C, 5K, and 5W of each unit. The bias power supply changes a valent of the transfer bias which is applied to the primary transfer roller by control of a control unit (not shown).

Hereinafter, an operation of forming a yellow image in the first unit 10Y will be described.

First, before starting the operation, the surface of the photoreceptor 1Y is charged with the potential in a range of −600 V to −800 V by the charging roller 2Y.

The photoreceptor 1Y is formed by stacking the photosensitive layers on the conductive substrate (for example, volume resistivity of equal to or less than $1\times10^{-6}$ Ωcm at 20° C.). The photosensitive layer typically has high resistance (the resistance of the typical resin), but when being irradiated with the laser beam, it has the property of changing the resistivity of a portion which is irradiated with the laser beam. In this regard, in accordance with image data for yellow transmitted from the control unit (not shown), the charged surface of the photoreceptor 1Y is irradiated with the laser beam from the exposure device 3Y. With this, the electrostatic charge image of a yellow image pattern is formed on the surface of the photoreceptor 1Y.

The electrostatic charge image means an image formed on the charged surface of the photoreceptor 1Y, in which resistivity of a portion of the photosensitive layer to be irradiated with the laser beam from the exposure device 3Y is decreased, and the charges for charging the surface of the photoreceptor 1Y flow; on the other hand, electrostatic charge image means a so-called negative latent image which is formed when charges of a portion which is not irradiated with the laser beam remain.

The electrostatic charge image formed on the photoreceptor 1Y is rotated to the predetermined developing position in accordance with the traveling of the photoreceptor 1Y. Further, the electrostatic charge image on the photoreceptor 1Y is visualized (developed) in the developing position as a toner image by the developing device 4Y.

The developing device 4Y contains, for example, an electrostatic charge image developer including at least a yellow toner and a carrier. The yellow toner is frictionally charged by being stirred in the developing device 4Y to have a charge with the same polarity (negative polarity) as the charge that is charged on the photoreceptor 1Y, and is thus held on the developer roller (an example of the developer holding member). By allowing the surface of the photoreceptor 1Y to pass through the developing device 4Y, the yellow toner electrostatically adheres to the erased latent image part on the surface of the photoreceptor 1Y, whereby the latent image is developed with the yellow toner. Next, the photoreceptor 1Y having the yellow toner image formed thereon continuously travels at a predetermined rate and the toner image developed on the photoreceptor 1Y is transported to a predetermined primary transfer position.

When the yellow toner image on the photoreceptor 1Y is transported to the primary transfer position, a primary transfer bias is applied to the primary transfer roller 5Y and an electrostatic force toward the primary transfer roller 5Y from the photoreceptor 1Y acts on the toner image, whereby the toner image on the photoreceptor 1Y is transferred onto the intermediate transfer belt 20. The transfer bias applied at this time has the opposite polarity (+) to the toner polarity (−), and, for example, is controlled to +10 μA in the first unit 10Y by the controller (not shown).

On the other hand, the toner remaining on the photoreceptor 1Y is removed and collected by a photoreceptor cleaning device 6Y.

The primary transfer biases that are applied to the primary transfer rollers 5M, 5C, 5K, and 5W of the second unit 10M and the subsequent units are also controlled in the same manner as in the case of the first unit.

In this manner, the intermediate transfer belt 20 onto which the yellow toner image is transferred in the first unit 10Y is sequentially transported through the second to fifth units 10M, 10C, 10K, and 10W and the toner images of respective colors are multiply-transferred in a superimposed manner.

The intermediate transfer belt 20 onto which the five color toner images have been multiply-transferred through the first to fifth units reaches a secondary transfer part that is composed of the intermediate transfer belt 20, the facing roller 24 contacting the inner surface of the intermediate transfer belt, and a secondary transfer roller (an example of the secondary transfer unit) 26 disposed on the image holding surface side of the intermediate transfer belt 20. Meanwhile, a recording sheet (an example of the recording medium) P is supplied to a gap between the secondary transfer roller 26 and the intermediate transfer belt 20, that contact with each other, via a supply mechanism at a predetermined timing, and a secondary transfer bias is applied to the facing roller 24. The transfer bias applied at this time has the same polarity (−) as the toner polarity (−), and an electrostatic force toward the recording sheet P from the intermediate transfer belt 20 acts on the toner image, whereby the toner image on the intermediate transfer belt 20 is transferred onto the recording sheet P. In this case, the secondary transfer bias is determined depending on the resistance detected by a resistance detecting unit (not shown) that detects the resistance of the secondary transfer part, and is voltage-controlled.

Thereafter, the recording sheet P is fed to a nip portion of a pair of fixing roller in a fixing device (an example of the fixing unit) 28 so that the toner image is fixed to the recording sheet P, and thereby a fixed image is formed.

Examples of the recording sheet P, to which the toner image is transferred, include plain paper that is used in electrophotographic copying machine, printers, and the like, and as a recording medium, an OHP sheet is also exemplified other than the recording sheet P.

In order to further improve the smoothness of the image surface after fixing, the surface of the recording sheet P is also preferably smooth. For example, coated paper obtained by coating the surface of plain paper with resin or the like, art paper for printing, or the like is preferably used.

The recording sheet P on which the fixing of the color image is completed is discharged toward a discharge part, and a series of the color image forming operations end.

Process Cartridge and Toner Cartridge

A process cartridge according to the exemplary embodiment will be described.

The process cartridge according to the exemplary embodiment is provided with a developing unit that accommodates the electrostatic charge image developer according to the exemplary embodiment and develops an electrostatic charge image formed on a surface of an image holding member with the electrostatic charge image developer to form a toner image, and is detachable from an image forming apparatus.

The process cartridge according to the exemplary embodiment is not limited to the above-described configuration, and may be configured to include a developing device, and as necessary, at least one selected from other units such as an image holding member, a charging unit, an electrostatic charge image forming unit, and a transfer unit.

Hereinafter, an example of the process cartridge according to this exemplary embodiment will be shown. However, the process cartridge is not limited thereto. Major parts shown in the drawing will be described, but descriptions of other parts will be omitted.

Figure 3:
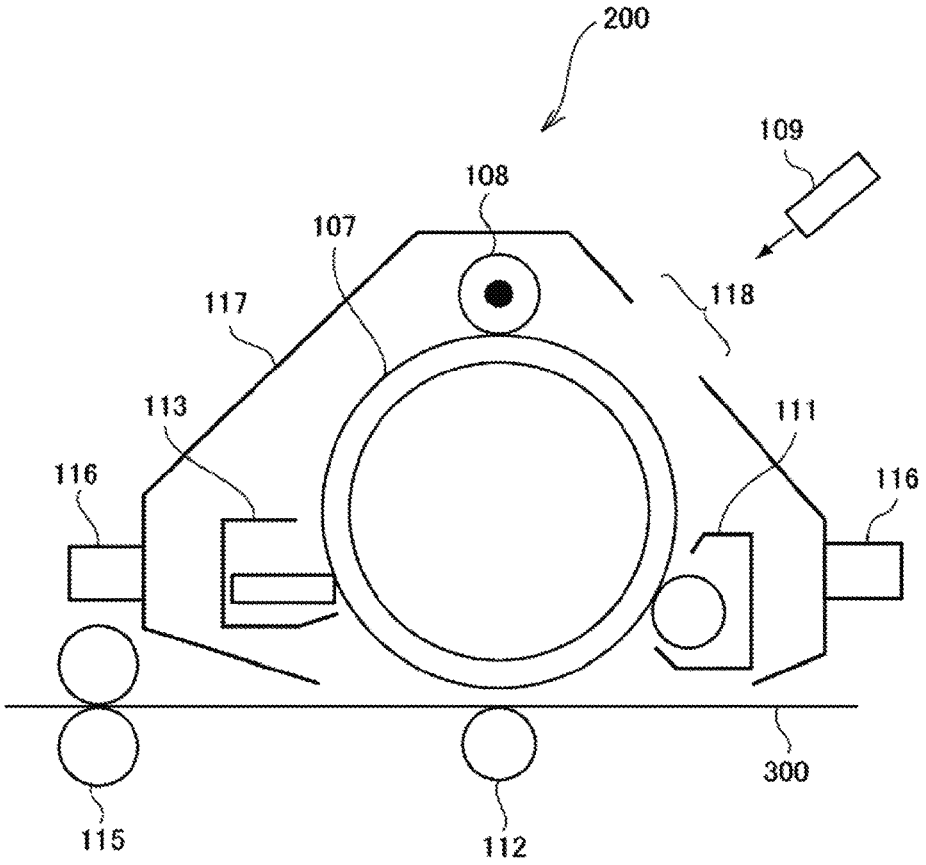
FIG. 3 is a configuration diagram illustrating an example of a process cartridge according to the exemplary embodiment.

FIG. 3 is a configuration diagram illustrating the process cartridge according to this exemplary embodiment.

The process cartridge 200 illustrated in FIG. 3 is configured such that a photoreceptor 107 (an example of the image holding member), a charging roller 108 (an example of the charging unit) which is provided in the vicinity of the photoreceptor 107, a developing device 111 (an example of the developing unit), and a photoreceptor cleaning device 113 (an example of the cleaning unit) are integrally formed in combination, and are held by a housing 117 which is provided with an attached rail 116 and an opening portion 118 for exposing light.

Note that, in FIG. 3, reference numeral 109 is denoted as an exposure device (an example of the electrostatic charge image forming unit), reference numeral 112 is denoted as a transfer device (an example of the transfer unit), reference numeral 115 is denoted as a fixing device (an example of the fixing unit), and reference numeral 300 is denoted as a recording sheet (an example of the recording medium).

Next, the toner cartridge of the exemplary embodiment will be described.

The toner cartridge according to the exemplary embodiment accommodates the toner according to the exemplary embodiment and is detachable from an image forming apparatus. The toner cartridge contains a toner for replenishment for being supplied to the developing unit provided in the image forming apparatus.

The image forming apparatus shown in FIG. 2 has such a configuration that the toner cartridges 8Y, 8M, 8C, 8K, and 8W are detachable therefrom, and the developing devices 4Y, 4M, 4C, 4K and 4W are connected to the toner cartridges corresponding to the respective developing devices (colors) via toner supply tubes (not shown), respectively. In addition, when the toner accommodated in the toner cartridge runs low, the toner cartridge is replaced. An example of the toner cartridge of the exemplary embodiment is the toner cartridge 8W.

EXAMPLES

Hereinafter, the exemplary embodiment will be described in detail with reference to Examples, but is not limited thereto.

In the following description, unless specifically noted, "parts" and "%" are based on the weight.

Preparation of Dispersion (1)

Titanium oxide particle (1) (product name: CR-60-2, prepared by ISHIHARA SANGYO KAISHA, Ltd.): 210 parts Nonionic surfactant (product name: NONIPOLE 400 prepared by SANYO CHEMICAL INDUSTRIES, Ltd.): 10 parts Ion exchange water: 480 parts The above-described materials are mixed with each other, the mixture is stirred with a homogenizer (ULTRA-TURRAX T50, manufactured by IKA Ltd) for 30 minutes, and then is dispersed for one hour by using a high pressure impact type dispersing machine ULTIMIZER (HJP30006: manufactured by Sugino Machine Limited Co., Ltd). Further, the resultant is kept to stand and the supernatant is removed so as to prepare a titanium oxide particle dispersion (1) (solid concentration: 30%) in which titanium oxide particles having a number average particle diameter of 300 nm are dispersed.

Preparation of Small-Diameter Titanium Oxide Particle Dispersion (S1)

Titanium oxide particle dispersion (1): 20 parts

Anionic surfactant (NEOGEN SC prepared by Daiichi Kogyo Seiyaku Co., Ltd.): 2 parts Ion exchange water: 78 parts The above-described materials are mixed with each other, the mixture is dispersed with a homogenizer (ULTRA-TURRAX T50, manufactured by IKA Ltd) at 6,000 rpm for five minutes, and the resultant is designated as a pre-dispersion.

After that, the pre-dispersion is stirred overnight with a stirrer to defoam and then is continuously dispersed at a pressure of 240 MPa by using a high pressure impact type dispersing machine ULTIMIZER (HJP30006: manufactured by Sugino Machine Limited Co., Ltd). The dispersion is performed by 20 passes. Then, the dispersion is separated at gravitational acceleration of $5.5\times10^4$ G for 35 minutes with a centrifugal machine (HIMAC CR22G, manufactured by Hitachi Koki Co., Ltd.), and is kept to stand for 25 minutes, and then the supernatant being in an amount of 30% by volume with respect to the total amount of the dispersion is collected and is designated as the small-diameter titanium oxide particle dispersion (S1). Note that, the small-diameter titanium oxide particle dispersion (S1) is also referred to as a hydrophilic small-diameter titanium oxide particle dispersion (S1).

Preparation of Large-Diameter Titanium Oxide Particle Dispersion (B1)

In the preparation of the small-diameter titanium oxide particle dispersion (S1), after being kept to stand for 25 minutes, the supernatant being in an amount of 30% by volume with respect to the total amount of the dispersion is collected, and the remaining liquid (that is, 70% by volume with respect to the total amount of the dispersion) is designated as the large-diameter titanium oxide particle dispersion (B1).

Preparation of Organic-Treated Surface Titanium Oxide Particle Dispersion (2)

The organic-treated surface titanium oxide particle dispersion (2) (solid concentration: 30%) in which the organic-treated surface titanium oxide particles having a number average particle diameter of 300 nm are dispersed is prepared in the same manner as in the preparation of the titanium oxide particle dispersion (1) except that 210 parts of organic-treated surface titanium oxide particles (product name: SJR-405, prepared by TAYCA CORPORATION, the volume average particle diameter of 0.3 μm) of which the surface is treated with silicone oil are used instead of the titanium oxide particles (1).

Preparation of Hydrophobic Large-Diameter Titanium Oxide Particle Dispersion (B2)

Organic-treated surface titanium oxide particle dispersion (2): 20 parts

Anionic surfactant (prepared by TAYCA CORPORATION, Tayca Power, solid concentration of 20%): 2 parts Ion exchange water: 78 parts The above-described materials are mixed with each other, the mixture is dispersed with a homogenizer (ULTRA-TURRAX T50, manufactured by IKA Ltd) at 6,000 rpm for five minutes, and the resultant is designated as a pre-dispersion. After that, the pre-dispersion is stirred overnight with a stirrer to defoam and then is continuously dispersed at a pressure of 240 MPa by using a high pressure impact type dispersing machine ULTIMIZER (HJP30006: manufactured by Sugino Machine Limited Co., Ltd). The dispersion is performed by 20 passes. Then, the dispersion is separated at gravitational acceleration of $5.5\times10^4$ G for 35 minutes with a centrifugal machine (HIMAC CR22G, manufactured by Hitachi Koki Co., Ltd.), and is kept to stand for 25 minutes, and then the supernatant being in an amount of 30% by volume with respect to the total amount of the dispersion is removed and the remaining liquid (that is, 70% by volume with respect to the total amount of the dispersion) is designated as the hydrophobic large-diameter titanium oxide particle dispersion (B2).

Preparation of Zinc Oxide Particle Dispersion

The zinc oxide particle dispersion (solid concentration: 30%) in which zinc oxide particles having a number average particle diameter of 300 nm are dispersed is prepared in the same manner as in the preparation of the titanium oxide particle dispersion (1) except that the titanium oxide particles (1) are changed to 210 parts of zinc oxide particles (product name: XZ-300F-LP, prepared by Sakai Chemical Industry Co., Ltd).

Preparation of Small-Diameter Zinc Oxide Particle Dispersion

The small-diameter zinc oxide particle dispersion is prepared in the same manner as in the preparation of the small-diameter titanium oxide particle dispersion (S1) except that titanium oxide particle dispersion (1) is changed to 20 parts of zinc oxide particle dispersion.

Preparation of Large-Diameter Zinc Oxide Particle Dispersion

The large-diameter zinc oxide particle dispersion is prepared in the same manner as in the preparation of the large-diameter titanium oxide particle dispersion (B1) except that the titanium oxide particle dispersion (1) is changed to 20 parts of zinc oxide particle dispersion.

Preparation of Resin Particle Dispersion

Terephthalic acid: 30 parts by mol

Fumaric acid: 70 parts by mol

Bisphenol A ethylene oxide adduct: 5 parts by mol

Bisphenol A propylene oxide adduct: 95 parts by mol

The above-described materials are put into a flask which has five liters of content, and equipped with a stirrer, a nitrogen inlet pipe, a temperature sensor, and a rectification column, the temperature of the flask is raised up to 210° C. over one hour, and then 1 part of titanium tetraethoxide is added to 100 parts of the above materials. While distilling off water to be generated, the temperature was raised up to 230° C. over 0.5 hours, dehydration condensation reaction is continued for one hour at the temperature, and then the reacted material is cooled. In this way, a polyester resin (1) having a weight average molecular weight of 18,500, an acid value of 14 mgKOH/g, and a glass transition temperature of 59° C. is synthesized.

40 parts of ethyl acetate and 25 parts of 2-butanol are put into a container provided with a temperature control unit and a nitrogen replacement unit so as to prepare a mixed solvent, then 100 parts of polyester resin is slowly put into the container and dissolved, and 10% by weight of ammonia aqueous solution (equivalent to three times the molar ratio with respect to the acid value of the resin) is put the container and stirred for 30 minutes.

Subsequently, the interior of the container is replaced with dry nitrogen, 400 parts of ion exchange water is added dropwise at a rate of 2 parts per minute while maintaining the temperature at 40° C. and stirring the mixed solution so as to perform emulsification. After completing the dropwise addition, the temperature of the emulsion is returned to room temperature (in a range of 20° C. to 25° C.) and bubbling with dry nitrogen is performed for 48 hours with stirring, so that the contents of ethyl acetate and 2-butanol are reduced to equal to or less than 1,000 ppm, thereby obtaining a resin particle dispersion in which a resin particle having a volume average particle diameter 200 nm is dispersed. The ion exchange water is added to the resin particle dispersion so as to adjust the solid concentration to be 30% by weight, and thus, a resin particle dispersion (1) is obtained.

Preparation of Release Agent Particle Dispersion

Paraffin wax (HNP-9, prepared by Nippon Seiro, Co., Ltd.): 45 parts

Anionic surfactant (NEOGEN RK manufactured by Daiichi Kogyo Seiyaku Co., Ltd.): 5 parts Ion exchange water: 200 parts The above-described materials are mixed with each other, the mixture is heated at 100° C., is dispersed with a homogenizer (ULTRA-TURRAX T50, manufactured by IKA Ltd.), and then is subjected to a dispersing treatment with Manton-Gaulin high pressure homogenizer (manufactured by Manton Gaulin Mfg Company Inc), thereby obtaining a release agent particle dispersion (1) (solid concentration: 20%) in which release agent particles having a volume average particle diameter of 200 nm are dispersed.

Example 1

Preparation of White Toner Particle (W1)

Resin particle dispersion: 130 parts

Large-diameter titanium oxide particle dispersion (B1): 170 parts

Release agent particle dispersion: 50 parts

Anionic surfactant (prepared by TAYCA CORPORATION, Tayca Power, solid concentration of 20%): 2 parts Ion exchange water: 450 parts The above-described materials are put into a round stainless steel flask, 0.1 N of sulfuric acid is added to the flask, pH is adjusted to 3.5, and then 30 parts of nitric acid aqueous solution having 10 weight % of concentration of polyaluminum chloride is added to the flask. Subsequently, the resultant is dispersed at 30° C. with a homogenizer (ULTRA-TURRAX T50, manufactured by IKA Ltd.), and then the diameter of the first aggregated particle is grown in an oil bath for heating while raising the temperature at 1° C./30 minutes (first aggregated particle forming step (core particle forming step)).

Then, 25 parts of small-diameter titanium oxide particle dispersion (S1), and 50 parts of resin particle dispersion are added, and are kept while being stirred for 30 minutes after completing the supply of the respective dispersions so as to form a second aggregated particle (second aggregated particle forming step (core particle/first shell layer forming step)). Subsequently, 50 parts of the resin particle dispersion is added thereto, and after completing the supply of the respective dispersions to the flask, the temperature is raised by 1° C., and the mixture is kept while being stirred for 30 minutes to thereby form a third aggregated particle (third aggregated particle forming step (core particle/first shell layer/second shell layer forming step)).

After that, 0.1 N aqueous sodium hydroxide solution is added to adjust the pH to 8.5, and the mixture is heated up to 85° C. while being continuously stirred, and is kept for five hours. Then, the resultant is cooled down to 20° C. at speed of 20° C./min, filtrated, washed with ion exchange water, and then dried so as to obtain a white toner particle (W1) having a volume average particle diameter of 9.0 μm (coalescence step).

In addition, 1.5 parts of silica particles (RY50, prepared by Nippon Aerosil Co., Ltd.) is mixed to 100 parts of white toner particle (W1) at the peripheral speed of 30 m/s for three minutes in a HENSCHEL mixer (manufactured by Mitsui Miike Machinery Co., Ltd.) Then, sieving is performed with a vibration screen having an aperture of 45 μm so as to prepare a white toner (W1).

Example 2

Preparation of White Toner Particle (W2)

First, an apparatus (refer to FIG. 1) is prepared, in which the round stainless steel flask and a container A are connected to each other via a tube pump A, a liquid stored in the container A is supplied to the flask in accordance with the driving of the tube pump A, the container A and a container B are connected to each other via a tube pump B, and a liquid stored in the container B is supplied to the container A in accordance with the driving of the tube pump B. Then, with such an apparatus, the following operations are performed.

Resin particle dispersion: 65 parts

Large-diameter titanium oxide particle dispersion (B1): 50 parts

Release agent particle dispersion: 50 parts

Anionic surfactant (manufactured by TAYCA CORPORATION, Tayca Power, solid concentration of 20*): 2 parts Ion exchange water: 450 parts The above-described materials are put into a round stainless steel flask, 0.1 N of sulfuric acid is added to the flask to adjust the pH to 3.5, and then 30 parts of a nitric acid aqueous solution having 10 weight % of concentration of polyaluminum chloride is added to the flask. Subsequently, the resultant is dispersed at 30° C. with a homogenizer (ULTRA-TURRAX T50, manufactured by IKA Ltd.), and then the diameter of the first aggregated particle is grown in an oil bath for heating while raising the temperature at 1° C./30 minutes (first aggregated particle forming step (core particle forming step)).

On the other hand, 100 parts by large-diameter titanium oxide particle dispersion (B1) and 100 parts by the resin particle dispersion are put into the container A which is a polyester bottle, and similarly, 30 parts of the small-diameter titanium oxide particle dispersion (S1) is put into the container B. Then, the following operations are performed.

The liquid supplying speed of the tube pump A is set to 6 parts per one minute, and the liquid supplying speed of the tube pump B is set to 3 parts per one minute.

Then, during the formation of the first aggregated particles, the temperature of the inside of the round stainless steel flask is raised at 1° C./minute, and when the particle diameter of the first aggregated particles becomes 5.5 μm, the raising temperature is stopped.

Subsequently, the large-diameter titanium oxide particle dispersion (B1) and the resin particle dispersion which are stored in the container A, and the small-diameter titanium oxide particle dispersion (S1) stored in the container B start to be supplied by driving the tube pumps A and B at the above-described liquid supplying speed. Further, the liquid stored in the container A is dropped along the wall in the flask. With this, the mixed dispersion in which the large-diameter titanium oxide particles, the resin particles, and the small-diameter titanium oxide particles are dispersed is supplied to the round stainless steel flask containing the first aggregated particles from the container A. In addition, the dispersion is kept while being stirred for 30 minutes after completing the supply of the respective dispersions (mixed dispersion) to the flask so as to form a second aggregated particle (second aggregated particle forming step (core particle/first shell layer forming step)).

Then, 30 parts of the resin particle dispersion only is added to the round stainless steel flask containing the second aggregated particles. Then, after completing the supply of the resin particle dispersion to the flask, the temperature of the mixture is raised by 1° C., and the mixture is kept while being stirred for 30 minutes so as to form a third aggregated particle (third aggregated particle forming step (core particle/first shell layer/the second shell layer forming step)).

After that, 0.1 N aqueous sodium hydroxide solution is added, pH is adjusted to 8.5, and the mixture is heated up to 85° C. while being continuously stirred, and is kept for five hours. Then, the resultant is cooled down to 20° C. at speed of 20° C./min, filtrated, washed with ion exchange water, and then dried so as to obtain a white toner particle (W2) having a volume average particle diameter of 9.0 m (coalescence step).

In addition, white toner (W2) is obtained in the same manner as in the preparation of the white toner (W1) except that the white toner particles (W2) are used.

Example 3

Preparation of White Toner Particle (W3)

40 parts of titanium oxide particles (product name: CR-60, prepared by ISHIHARA SANGYO KAISHA, Ltd., the volume average particle diameter of 0.2 μm) are added to 60 parts of the amorphous polyester resin (the polyester resin which is synthesized at the time of preparing the resin particle dispersion), and the mixture is kneaded with a pressure kneader. The obtained kneaded material is coarsely pulverized so as to prepare the masterbatch formed of the resin and the small-diameter titanium oxide particles. Then, a shell layer forming dispersion is obtained according to the same method as described above except that the polyester resin used in the preparation of the above-described resin particle dispersion is substituted with the obtained masterbatch.

In the preparation of the white toner particle (W3), in the second aggregated particle forming step of Example 1, the second aggregated particles are grown in the same manner as in the case of the white toner particles (W1) except that the above-described shell layer forming dispersion is added instead of adding the resin particle dispersion and the small-diameter titanium oxide particle dispersion (S1). After that, the white toner particle (W3) is obtained by performing the same coalescence step as that of Example 1.

In addition, white toner (W3) is obtained in the same manner as in the preparation of the white toner (W1) except that the white toner particles (W3) are used.

Example 4

Preparation of White Toner Particle (W4)

Resin particle dispersion: 230 parts

Hydrophobic large-diameter titanium oxide particle dispersion (B2): 170 parts

Hydrophilic small-diameter titanium oxide particle dispersion (S1): 25 parts

Release agent particle dispersion: 50 parts

Anionic surfactant (prepared by TAYCA CORPORATION, Tayca Power, solid concentration of 20%): 2 parts Ion exchange water: 450 parts The above-described materials are put into a round stainless steel flask, 0.1 N of sulfuric acid is added to the flask, pH is adjusted to 3.5, and then 30 parts of nitric acid aqueous solution having 10 weight % of concentration of polyaluminum chloride is added to the flask. Subsequently, the resultant is dispersed at 30° C. with a homogenizer (ULTRA-TURRAX T50, manufactured by IKA Ltd.), and then the diameter of the first aggregated particle is grown in an oil bath for heating while raising the temperature at 1° C./30 minutes (aggregated particle forming step).

After that, 0.1 N aqueous sodium hydroxide solution is added to adjust the pH to 7.5, and the mixture is heated up to 92° C. while being continuously stirred, and is kept for five hours. Then, the resultant is cooled down to 20° C. at speed of 20° C./min, filtrated, washed with ion exchange water, and then dried so as to obtain a white toner particle (W4) having a volume average particle diameter of 9.0 μm (coalescence step).

In addition, a white toner (W4) is obtained in the same manner as in the preparation of the white toner (W1) except that the white toner particles (W4) are used.

Example 5

A white toner particle (W5) is obtained in the same manner as in the preparation of the white toner particle (W2) except that the liquid supplying speed of the tube pump A is 4 parts/minute, and the amount of the large-diameter titanium oxide particle dispersion (B1) used in the first aggregated particle forming step is changed to 70 parts in the preparation of the white toner particle (W2).

In addition, white toner (W5) is obtained in the same manner as in the preparation of the white toner (W2) except that the white toner particles (W5) are used.

Example 6

Preparation of White Toner Particle (W6)

A white toner particle (W6) is prepared in the same manner as in the preparation of the white toner particle (W1) except that large-diameter titanium oxide particle dispersion (B1) is changed to the large-diameter zinc oxide particle dispersion, and the small-diameter titanium oxide particle dispersion (S1) is changed to the small-diameter zinc oxide particle dispersion in the preparation of the white toner particle (W1).

In addition, a white toner (W6) is obtained in the same manner as in the preparation of the white toner (W1) except that the white toner particles (W6) are used.

Comparative Example 1

40 parts of titanium oxide particles (product name: CR-60, prepared by ISHIHARA SANGYO KAISHA, Ltd., the volume average particle diameter of 0.2 μm) is added to 60 parts of the amorphous polyester resin (the polyester resin which is synthesized at the time of preparing the resin particle dispersion), and the mixture is kneaded with a pressure kneader. The obtained kneaded material is coarsely pulverized so as to a white toner particle (C1) having a volume average particle diameter of 9.0 μm.

In addition, a white toner (C1) is obtained in the same manner as in the preparation the white toner (W1) except that the white toner particle (C1) is used.

Comparative Example 2

Resin particle dispersion: 230 parts

Titanium oxide particle dispersion (1): 195 parts

Release agent particle dispersion: 50 parts

Anionic surfactant (prepared by TAYCA CORPORATION, Tayca Power, solid concentration of 20%): 2 parts Ion exchange water: 450 parts The above-described materials are put into a round stainless steel flask, 0.1 N of sulfuric acid is added to the flask to adjust the pH to 3.5, and then 30 parts of nitric acid aqueous solution having 10 weight % of concentration of polyaluminum chloride is added to the flask. Subsequently, the resultant is dispersed at 30° C. with a homogenizer (ULTRA-TURRAX T50, manufactured by IKA Ltd.), and then the diameter of the first aggregated particle is grown in an oil bath for heating while raising the temperature at 1° C./30 minutes.

After that, 0.1 N aqueous sodium hydroxide solution is added to adjust the pH to 8.5, and the mixture is heated up to 85° C. while being continuously stirred, and is kept for five hours. Then, the resultant is cooled down to 20° C. at speed of 20° C./min, filtrated, washed with ion exchange water, and then dried so as to obtain a white toner particle (C2) having a volume average particle diameter of 9.0 μm.

In addition, white toner (C2) is obtained in the same manner as in the preparation of the white toner (W1) except that the white toner particles (C2) are used.

Comparative Example 3

A white toner particle (C3) is obtained in the same manner as in the preparation of the white toner particle (W2) except that the liquid supplying speed of the tube pump A is 2 parts/minute, the liquid supplying speed of the tube pump B is 6 parts/minute, the amount of small-diameter titanium oxide particle dispersion (S1) stored in the container B is changed to 50 part, and the supplying of the liquid from the container A is started when the toner volume particle diameter becomes 5.5 μm, and the supplying of the liquid from the container B is started when the temperature reaches 35° C. in the preparation of the white toner particle (W2).

In addition, a white toner (C3) is obtained in the same manner as in the preparation of the white toner (W2) except that the white toner particle (C3) is used.

Comparative Example 4

A white toner particle (C4) is obtained in the same manner as in the preparation of the white toner particle (W2) except that the liquid supplying speed of the tube pump A is 4 parts/minute, the liquid supplying speed of the tube pump B is 3 parts/minute in the preparation of the white toner particle (W2).

In addition, a white toner (C4) is obtained in the same manner as in the preparation of the white toner (W2) except that the white toner particle (C4) is used.

Comparative Example 5

A white toner particle (C5) is obtained in the same manner as in the preparation of the white toner particle (W2) except that the liquid supplying speed of the tube pump A is 6 parts/minute, the liquid supplying speed of the tube pump B is 10 parts/minute in the preparation of the white toner particle (W2).

In addition, a white toner (C5) is obtained in the same manner as in the preparation of the white toner (W2) except that the white toner particle (C5) is used.

Comparative Example 6

A white toner particle (C6) is obtained in the same manner as in the preparation of the white toner particle (W2) except that the liquid supplying speed of the tube pump A is 6 parts/minute, the liquid supplying speed of the tube pump B is 6 parts/minute, and the supplying of the liquid of the container A is started when the toner volume particle diameter becomes 5.5 μm, and the supplying of the liquid from the container B is started when the toner volume particle diameter becomes 6.5 μm in the preparation of the white toner particle (W2).

In addition, a white toner (C6) is obtained in the same manner as in the preparation of the white toner (W2) except that the white toner particle (C6) is used.

Preparation of White Developer

Ferrite particle (number average particle diameter of 50 μm): 100 parts

Toluene: 14 parts

Copolymer of styrene and methyl methacrylate (copolymerization ratio of 15/85): 3 parts Carbon black: 0.2 parts The above-described materials excluding the ferrite particle are dispersed in a sand mill so as to prepare a dispersion, and the obtained dispersion is put into a vacuum degassing type kneader together with the ferrite particle, and then is dried under reduced pressure with stirring, thereby obtaining a carrier.

Then, 20 parts of white toner is mixed to 200 parts of the carrier so as to obtain a white developer.

Regarding the white pigment particles (hereinafter, also simply referred to as "pigment particle") contained in the toner particle, the number average circle equivalent diameter A and the number average circle equivalent diameter B, the number (% by number) of the large-diameter pigment particles (pigment particle having an equivalent circle diameter in a range of 200 nm to 400 nm) and the number (% by number) of the small-diameter pigment particles (pigment particles having an equivalent circle diameter in a range of 10 nm to 100 nm) with respect to the entirety of the toner particle, the ratio (surface layer portion/inner portion) of the area occupancy ratio of the small-diameter pigment particles in the surface layer portion to the area occupancy ratio of the small-diameter pigment particles in the inner portion, and the ratio (surface layer portion/inner portion) of the area occupancy ratio of the large-diameter pigment particles in the surface layer portion to the area occupancy ratio of the large-diameter pigment particles in the inner portion are calculated with the white toners obtained in the respective examples according to the above-described method. The results are indicated in Table 1.

Evaluation

A modified apparatus of Color 1000 Press manufactured by Fuji Xerox Co., Ltd. (an image forming apparatus modified so as to be operated as long as a developer is contained in at least one developing device even if no developer is contained in the other developing devices) is prepared, and a white developer is put into a developing device. A sample image for the following evaluation is formed by using the modified apparatus.

Evaluation of Concealing Properties

White solid images having a toner applied amount (TMA) of 8 g/m$^2$ or 15 g/m$^2$ are continuously printed on an OHP film (manufactured by Fuji Xerox Co., Ltd.) at a fixing temperature of 160° C. A black portion of a JIS hiding power chart (available from Motofuji) is placed below the obtained 100,000th sheet having a sample image (white solid image), and a transmission density of the sample image is evaluated with an image densitometer (X-Rite 404A, manufactured by X-Rite, Inc.) based on the following criteria. Note that, a 5×5 cm patch is formed on the sample image, five locations (the center and four corners) of the sample image are measured in terms of transmission density, and the average value is designated as the transmission density. The acceptable range is from G2.

Further, the same evaluation is performed by changing the OHP film to mirror coat platinum paper (manufactured by Oji Paper Co., Ltd). The results are shown in Table 1. Note that, in Table 1, the mirror coat platinum paper is simply indicated as "mirror coat" (The same applies hereafter).

Evaluation Criteria

G1: Transmission density is equal to or greater than 3.00

G2: Transmission density is equal to or greater than 2.50 and less than 3.00

G3: Transmission density is less than 2.50

Pencil Hardness Evaluation/Fixability at Low Temperature

White an solid image having a toner applied amount (TMA) of 8 g/m$^2$ or 15 g/m$^2$ is continuously printed on an OHP film (manufactured by Fuji Xerox Co., Ltd.) under the low temperature fixing condition (fixing temperature of 150° C.). Similarly to the evaluation of the concealing properties, regarding the obtained 100,000th sheet having a sample image, five places are scratched with a needle having a needle tip diameter of 0.2 mm at a load of 50 g and each degree of deficiency is visually observed with a surface tester (HEIDON TYPE 14DR, manufactured by Shinto Scientific Co., Ltd), and the evaluation is performed based on the following criteria. The acceptable range is from G2. The pencil hardness evaluation is an index indicating the fixing strength. That is, it becomes an index indicating the fixability.

Further, the same evaluation is performed by changing the OHP film to mirror coat platinum paper (manufactured by Oji Paper Co., Ltd). The results are shown in Table 1.

Evaluation Criteria

G1: No scratches on surface and no image defects

G2: Scratches on surface but no image defects

G3: Surface is partially peeled off, or image defects occur in one or two places (within five places)

G4: Image defects occur in three places (within five places)

Hot Offset Evaluation/Hot Offset Resistance

A white solid image having a toner applied amount (TMA) of 8 g/m$^2$ or 15 g/m$^2$ is continuously printed on an OHP film (manufactured by Fuji Xerox Co., Ltd.) under the high temperature fixing condition (fixing temperature of 200° C.). Similarly to the evaluation of the concealing properties, regarding the obtained 100,000th sheet having a sample image, the gloss of the white solid portion and the adhesion (offset) to the fixing roller are evaluated based on the following criteria. The acceptable range is from G2.

Further, the same evaluation is performed by changing the OHP film to mirror coat platinum paper (manufactured by Oji Paper Co., Ltd). The results are shown in Table 1.

Evaluation Criteria

G1: Fixed image is nearly uniform and has high gloss, and offset is not confirmed G2: Fixed image has low gloss overall, and toner adhesion is slightly confirmed on fixing roller, but no offset occurs G3: Fixed image has low gloss overall, and offset is slightly confirmed G4: offset is confirmed (no image is left)

| | | | Example 1 | Example 2 | Example 3 | Example 4 | Example 5 | Example 6 |
|---|---|---|---|---|---|---|---|---|
| Number average circle equivalent diameter A of white pigment particles (nm) | | | 250 | 250 | 300 | 250 | 250 | 250 |
| Number average circle equivalent diameter B of white pigment particles (nm) | | | 50 | 50 | 50 | 50 | 50 | 50 |
| Number of white pigment particles with respect to the entirety of the toner particle (% by number) | 200 nm to 400 nm | | 50 | 50 | 50 | 50 | 30 | 60 |
| | 10 nm to 100 nm | | 8 | 10 | 12 | 14 | 10 | 10 |
| Number of white pigment particles with respect to surface layer portion (% by number) | 200 nm to 400 nm | | 10 | 10 | 10 | 15 | 10 | 20 |
| | 10 nm to 100 nm | | 25 | 30 | 35 | 20 | 30 | 25 |
| Area occupancy ratio of small-diameter pigment particles with respect to surface layer portion (10 nm to 100 nm) (%) | | | 25 | 25 | 25 | 10 | 20 | 25 |
| Ratio (surface layer/inner portion) of area occupancy ratio of small-diameter pigment particles (10 nm to 100 nm) | | | 5 | 5 | 5 | 2 | 5 | 5 |
| Ratio (surface layer/inner portion) of area occupancy ratio of large-diameter pigment particles (200 nm to 400 nm) | | | 0.5 | 0.5 | 0.5 | 0.8 | 0.5 | 0.5 |
| Concealing properties | TMA 8 g/m$^2$ | OHP | G1 | G1 | G1 | G1 | G2 | G1 |
| | | Mirror coat | G1 | G1 | G1 | G1 | G1 | G1 |
| | TMA 15 g/m$^2$ | OHP | G1 | G1 | G1 | G1 | G2 | G1 |
| | | Mirror coat | G1 | G1 | G1 | G1 | G1 | G1 |
| Pencil hardness | TMA 8 g/m$^2$ | OHP | G1 | G1 | G1 | G1 | G1 | G1 |
| | | Mirror coat | G1 | G1 | G1 | G1 | G1 | G1 |
| | TMA 15 g/m$^2$ | OHP | G1 | G1 | G1 | G1 | G1 | G2 |
| | | Mirror coat | G1 | G1 | G1 | G1 | G1 | G2 |
| Hot offset | TMA 8 g/m$^2$ | OHP | G2 | G2 | G1 | G2 | G2 | G1 |
| | | Mirror coat | G1 | G1 | G1 | G2 | G2 | G2 |
| | TMA 15 g/m$^2$ | OHP | G2 | G1 | G1 | G1 | G1 | G1 |
| | | Mirror coat | G1 | G1 | G1 | G1 | G1 | G1 |

| | Comparative Example 1 | Comparative Example 2 | Comparative Example 3 | Comparative Example 4 | Comparative Example 5 | Comparative Example 6 |
|---|---|---|---|---|---|---|
| Number average circle equivalent diameter A of white pigment particles (nm) | 300 | 300 | 150 | 250 | 230 | 150 |

-continued

| | | | | | | | | |
|---|---|---|---|---|---|---|---|---|
| Number average circle equivalent diameter B of white pigment particles (nm) | | | 300 | 330 | 200 | 300 | 280 | 150 |
| Number of white pigment particles with respect to the entirety of the toner particle (% by number) | 200 nm to 400 nm | | 50 | 50 | 50 | 50 | 50 | 50 |
| | 10 nm to 100 nm | | 5 | 10 | 20 | 10 | 10 | 15 |
| Number of white pigment particles with respect to surface layer portion (% by number) | 200 nm to 400 nm | | 30 | 20 | 10 | 25 | 20 | 10 |
| | 10 nm to 100 nm | | 3 | 5 | 30 | 30 | 2 | 60 |
| Area occupancy ratio of small-diameter pigment particles with respect to surface layer portion (10 nm to 100 nm) (%) | | | 10 | 7 | 10 | 3 | 3 | 55 |
| Ratio (surface layer/inner portion) of area occupancy ratio of small-diameter pigment particles (10 nm to 100 nm) | | | 1.1 | 0.8 | 0.6 | 5 | 0.6 | 15 |
| Ratio (surface layer/inner portion) of area occupancy ratio of large-diameter pigment particles (200 nm to 400 nm) | | | 1.3 | 0.8 | 0.5 | 0.9 | 0.5 | 0.5 |
| Concealing properties | TMA 8 g/m$^2$ | OHP | G1 | G1 | G2 | G1 | G1 | G2 |
| | | Mirror coat | G1 | G1 | G1 | G1 | G1 | G1 |
| | TMA 15 g/m$^2$ | OHP | G1 | G1 | G1 | G1 | G1 | G1 |
| | | Mirror coat | G1 | G1 | G1 | G1 | G1 | G1 |
| Pencil hardness | TMA 8 g/m$^2$ | OHP | G3 | G3 | G4 | G3 | G3 | G3 |
| | | Mirror coat | G2 | G2 | G3 | G2 | G3 | G3 |
| | TMA 15 g/m$^2$ | OHP | G3 | G4 | G4 | G3 | G4 | G4 |
| | | Mirror coat | G3 | G4 | G4 | G2 | G4 | G4 |
| Hot offset | TMA 8 g/m$^2$ | OHP | G4 | G4 | G2 | G4 | G4 | G1 |
| | | Mirror coat | G4 | G4 | G2 | G4 | G4 | G1 |
| | TMA 15 g/m$^2$ | OHP | G4 | G4 | G1 | G3 | G4 | G1 |
| | | Mirror coat | G3 | G3 | G1 | G2 | G3 | G1 |

From the above results, it is understood that the pencil hardness evaluation and the offset evaluation are better in Examples as compared with Comparative Examples. Further, it is understood that the white toner layer is excellent in the concealing properties.

Accordingly, in Examples, it is possible to obtain the white toner in which the excellent fixability at a low temperature and the hot offset resistance are realized.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A white toner for developing an electrostatic charge image, comprising:

a white toner particle containing a binder resin and a white pigment particle, wherein, when a number average circle equivalent diameter of the white pigment particles, which are observed in a sectional image of the white toner particle, is taken as A, and a number average circle equivalent diameter of the white pigment particles, which are present in a surface layer portion within 35% from a surface of the white toner particle with respect to a particle diameter thereof, is taken as B, a relationship expressed by A>B is satisfied.

2. The white toner for developing an electrostatic charge image according to claim 1, wherein, in the surface layer portion, a ratio of an area occupied by the white pigment particles having an equivalent circle diameter in a range of 10 nm to 100 nm is from 5% to 50%.

3. The white toner for developing an electrostatic charge image according to claim 1, wherein the number of the white pigment particles having an equivalent circle diameter in a range of 200 nm to 400 nm is 40% by number or more and the number of the white pigment particles having an equivalent circle diameter in a range of 10 nm to 100 nm is from 5% by number to 15% by number, with respect to the white pigment particles present in the entirety of the white toner particle.

4. The white toner for developing an electrostatic charge image according to claim 1, wherein the number of the white pigment particles having an equivalent circle diameter in a range of 200 nm to 400 nm is 20% by number or less, and the number of the white pigment particles having an equivalent circle diameter in a range of 10 nm to 100 nm is from 10% by number to 50% by number, with respect to the white pigment particles present in the surface layer portion of the white toner particle.

5. The white toner for developing an electrostatic charge image according to claim 1, wherein a ratio (surface layer portion/inner portion) of a ratio of an area occupied by the white pigment particles, which are present in the surface layer portion of the white toner particle and have an equivalent circle diameter in a range of 10 nm to 100 nm, to a ratio of an area occupied by the white pigment particles, which are present in an inner portion from the surface layer portion of the toner particle and have an equivalent circle diameter in a range of 10 nm to 100 nm, is in a range of 1/0.9 to 1/0.1.

6. The white toner for developing an electrostatic charge image according to claim 1, wherein a ratio (surface layer portion/inner portion) of a ratio of an area occupied by the white pigment particles, which are present in the surface layer portion of the white toner particle and have an equivalent circle diameter in a range of 200 nm to 400 nm, to a ratio of an area occupied by the white pigment particles, which are present in an inner portion from the surface layer portion of the toner particle and have an equivalent circle diameter in a range of 200 nm to 400 nm, is in a range of 1/10 to 1/1.2.

7. The white toner for developing an electrostatic charge image according to claim 1, wherein the white pigment particle contains titanium oxide.

8. The white toner for developing an electrostatic charge image according to claim 1, wherein the binder resin contains a polyester resin having a glass transition temperature of 50° C. to 80° C.

9. An electrostatic charge image developer comprising:

the white toner for developing an electrostatic charge image according to claim 1.

10. A toner cartridge comprising:

a container that contains the electrostatic charge image developing toner according to claim 1, wherein the toner cartridge is detachable from an image forming apparatus.

* * * * *